US012378860B2

(12) United States Patent
Nielsen et al.

(10) Patent No.: US 12,378,860 B2
(45) Date of Patent: Aug. 5, 2025

(54) MODULES AND CONFIGURATIONS OF MODULES FOR HYDROCARBON WELLS

(71) Applicant: Scovan Engineering Inc., Calgary (CA)

(72) Inventors: Donovan Nielsen, Calgary (CA); Oliver Kohlhammer, Calgary (CA)

(73) Assignee: Scovan Engineering Inc., Calgary (CA)

( * ) Notice: Subject to any disclaimer, the term of this patent is extended or adjusted under 35 U.S.C. 154(b) by 126 days.

(21) Appl. No.: 18/217,052

(22) Filed: Jun. 30, 2023

(65) Prior Publication Data

US 2024/0003234 A1 Jan. 4, 2024

(30) Foreign Application Priority Data

Jun. 30, 2022 (CA) ..... CA 3166098

(51) Int. Cl.
*E21B 43/24* (2006.01)

(52) U.S. Cl.
CPC ..... *E21B 43/2406* (2013.01)

(58) Field of Classification Search
CPC ..... E21B 43/30; E21B 43/2406
See application file for complete search history.

(56) References Cited

U.S. PATENT DOCUMENTS

| | | | |
|---|---|---|---|
| 9,664,026 B2 | 5/2017 | Greene | |
| 10,577,893 B2 | 3/2020 | Lau | |
| 2018/0073338 A1 | 3/2018 | Staley | |
| 2018/0087365 A1 | 3/2018 | Leroux | |
| 2019/0048700 A1 | 2/2019 | Hardy | |
| 2019/0301269 A1* | 10/2019 | Liu | E21B 43/2406 |
| 2020/0386089 A1 | 12/2020 | Moore | |

FOREIGN PATENT DOCUMENTS

| | | |
|---|---|---|
| CA | 2584627 C | 1/2010 |
| CA | 2641059 C | 7/2011 |
| CA | 2654848 C | 10/2013 |
| CA | 2797368 C | 11/2015 |
| CA | 2875579 C | 2/2016 |
| CA | 2917538 A1 | 7/2017 |
| CA | 2905891 C | 8/2017 |
| CA | 2978754 A1 | 3/2018 |
| CA | 2937117 C | 10/2019 |

(Continued)

*Primary Examiner* — Dany E Akakpo
(74) *Attorney, Agent, or Firm* — Dickinson Wright PLLC; Andrew D. Dorisio

(57) ABSTRACT

A steam assisted gravity drainage (SAGD) system having a hub module operatively coupled to a pipe rack module. The pipe rack module having a first side and a second side. An injection module operatively coupled to the pipe rack module. The injection module providing a high pressure steam via at least one high pressure steam line to an injection well. A production module operatively coupled to the pipe rack module. The production module receiving an emulsion into a produced emulsion line from at least one production well. The hub module permits the injection module to be located on either the first side or the second side of the pipe rack module and the production module to be located on either the first side or the second side of the pipe rack module.

20 Claims, 22 Drawing Sheets

(56) References Cited

FOREIGN PATENT DOCUMENTS

| | | | |
|---|---|---|---|
| CA | 3004170 | C | 9/2020 |
| CA | 3014272 | C | 9/2020 |
| CA | 3014562 | C | 9/2020 |
| CA | 3057354 | A1 | 4/2021 |
| CA | 2974022 | C | 9/2022 |

* cited by examiner

MODULES AND CONFIGURATIONS OF MODULES FOR HYDROCARBON WELLS

FIELD

This invention is in the field of oil sand wells, and more specifically to wellpads and modules for injection and production wells.

BACKGROUND

Steam-assisted gravity drainage (SAGD) is an oil recovery technology for producing heavy crude oil and bitumen. The system generally has a pair of horizontal wells drilled into an oil reservoir. The upper well is located above the lower well. A high pressure steam is continuously injected into the upper wellbore to heat the oil and reduce its viscosity resulting in the heated oil to drain into the lower wellbore.

SUMMARY

There is provided a steam assisted gravity drainage (SAGD) system that may have: a hub module operatively coupled to one or more pipe rack modules; an injection module operatively coupled to at least one of the one or more pipe rack modules; and a production module operatively coupled to at least one of the one or more pipe rack modules. The one or more pipe rack modules may have a first side and a second side. The injection module may provide a high pressure steam via one or more high pressure steam lines to one or more injection wells. The production module may receive one or more emulsions into a produced emulsion line from one or more production wells. The hub module may be configured to permit the injection module to be located on either the first side or the second side of the one or more pipe rack module and the production module to be located on either the first side or the second side of the at least one pipe rack module.

The pipe rack module may comprise: a main emulsion line, a produced gas line, a main high pressure steam line, a fuel gas line, and an instrument air line. The pipe rack module may further comprise at least one of: a test emulsion line and a test produced gas line.

The high pressure steam line may receive the high pressure steam from the main high pressure steam line via at least one pressure reduction system. The pressure reduction system may comprise a gate valve with a globe valve branching off an inlet of the gate valve and a flow return to the gate valve wherein adjusting the flow return through the globe valve results in a pressure adjustment to a supplied pressure to the injection module.

The production module may provide the at least one emulsion from the production well to a production coupling of the pipe rack module; the production coupling introducing the at least one emulsion to the emulsion line. The production module may receive at least one produced gas from the production well. The production module may provide a process fluid to the at least one production well.

A steam sweep module at an end of the pipe rack module; and the steam sweep module may provide the high pressure steam to at least one of: the emulsion line, the produced gas line, the fuel gas line, the test emulsion line, and the test produced gas line.

The injection module may receive the high pressure steam from the main high pressure steam line via a high pressure steam header. The high pressure steam line may comprise a long string high pressure steam line and a short string high pressure steam line. The injection module may separate the high pressure steam into the long string high pressure steam line and the short string high pressure steam line. The injection module is integrated into the pipe rack module. The injection module may receive a process fluid from the at least one injection well.

The long string high pressure steam line may comprise: a vortex flow meter with a flow indicator; a spring and diaphragm actuator with a flow regulator controlled by a pneumatic signal from the instrument air line; a pressure measurement system; and a fuel gas being introduced to the long string high pressure steam line via the fuel gas line.

The short string high pressure steam line may comprise: a vortex flow meter with a flow indicator; a spring and diaphragm actuator with a flow regulator controlled by a pneumatic signal from the instrument air line; and a pressure measurement system. The short string high pressure steam line further may comprise a fuel gas being introduced to the short string high pressure steam line via the fuel gas line. The short string high pressure steam line may provide a circulation steam to the production module between the spring and diaphragm actuator and the pressure measurement system.

A thermowell may measure a temperature of the at least one emulsion; and a pressure measurement system for measuring a pressure of the produced emulsion line. The circulation steam may be introduced into the produced emulsion line before the thermowell.

The pipe rack modules may comprise: a test emulsion line, and a test produced gas line. A test emulsion may be sampled from the produced emulsion line and may be provided to a test emulsion line.

DESCRIPTION OF THE DRAWINGS

While the invention is claimed in the concluding portions hereof, example embodiments are provided in the accompanying detailed description which may be best understood in conjunction with the accompanying diagrams where like parts in each of the several diagrams are labeled with like numbers, and where:

DETAILED DESCRIPTION

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
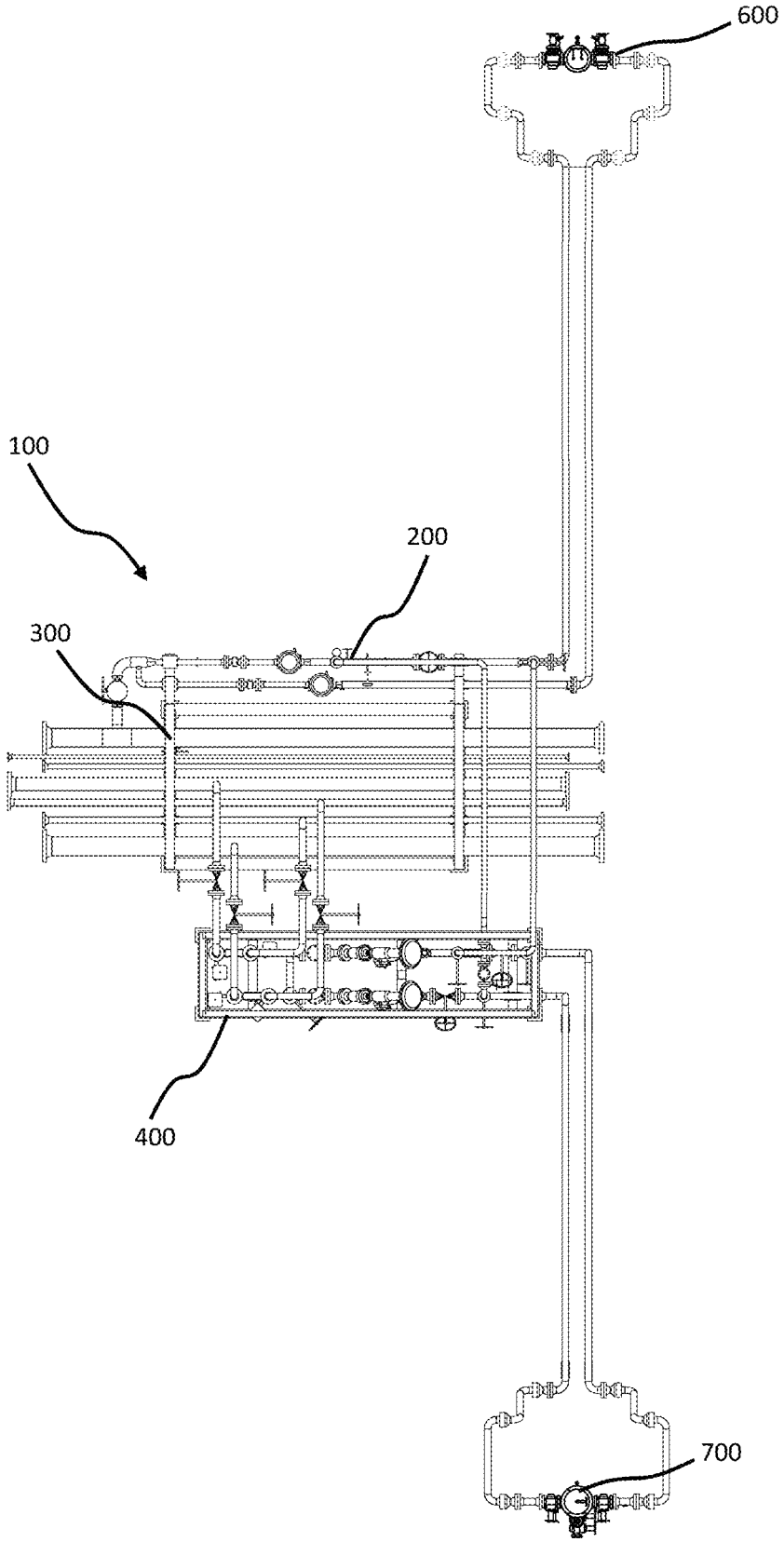
FIG. 1 is a top view of a single wellpair modular steam assisted gravity drainage (SAGD) system demonstrating an integrated injection and pipe rack module coupled to an injection wellhead and a production module coupled to a production wellhead.

As shown in FIG. 1, a modular steam assisted gravity drainage (SAGD) system 100 may be operatively coupled to one or more injection wellheads 600 and one or more production wellheads 700. In the aspect shown, the modular SAGD system 100 comprises an injection module 200 integrated with a pipe rack module 200 and coupled to an injection wellhead 600. The production module 400 may be placed in a horizontal configuration along the pipe rack module 200 and may be coupled to a production wellhead 700. The modules of the SAGD system 100 are described in further detail herein.

Figure 2:
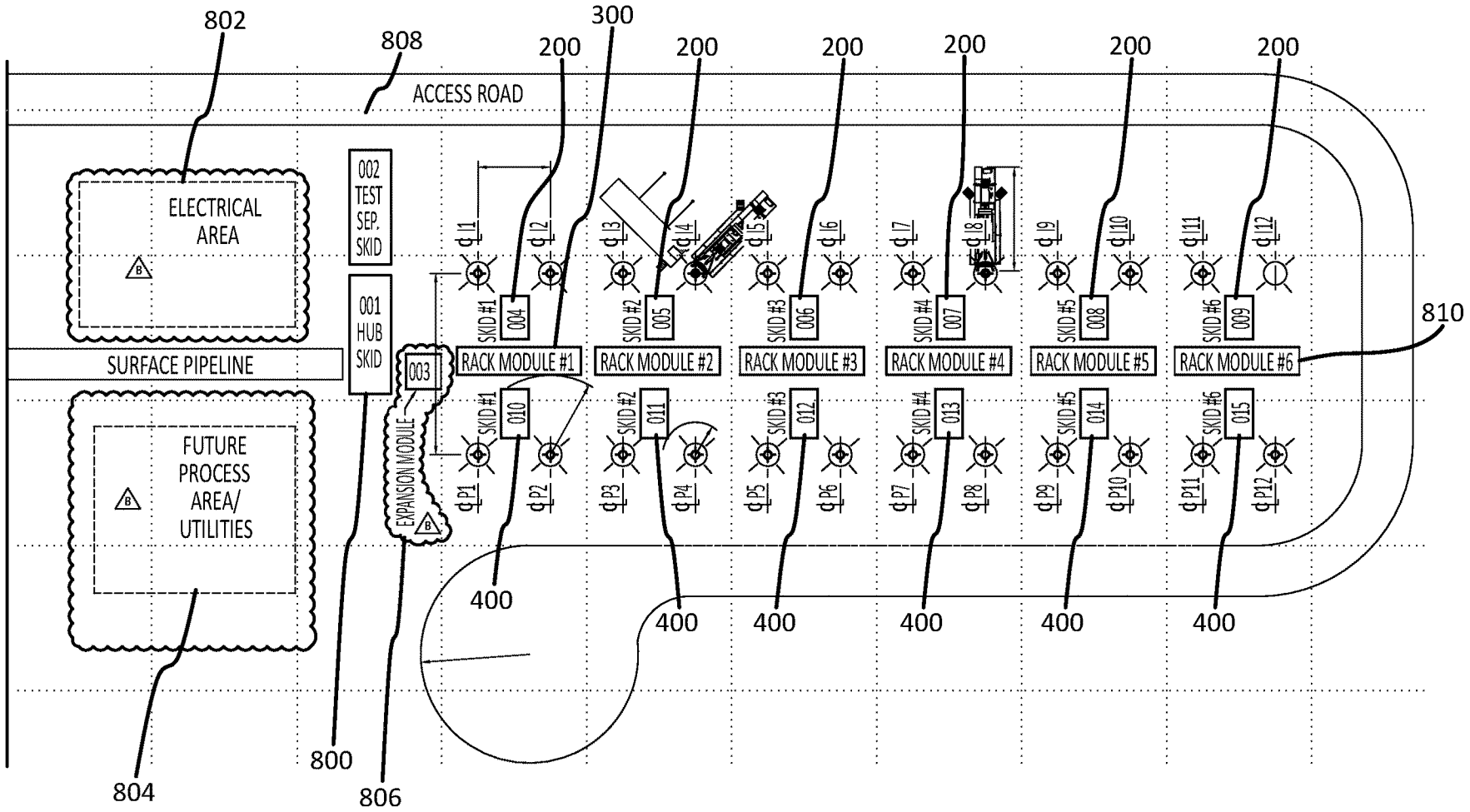
FIG. 2 is a top view of a plurality of the modular steam assisted gravity drainage (SAGD) wellpad operating in conjunction with a hub module.

Turning to FIG. 2, a plurality of the modular SAGD systems 100 may be operated in conjunction with a hub module 800. The hub module 800 may provide an ability to place the production modules 400 and/or the injection modules 200 in a number of different configurations. In this aspect, six module SAGD systems 100 are demonstrated each comprising the injection module 200, the pipe rack module 300, and the production module 400. Only a single pipe rack module 300 is labeled to improve clarity of the drawing. A pipe rack 810 may comprise the plurality of pipe rack modules 300. In the aspect shown, all of the injection modules 200 are placed on one side of the pipe rack 810 and the production modules 400 are placed on the other side of the pipe rack 810. Other aspects may have the injection modules 200 and production modules 400 alternate positions along the pipe rack 810. All of the modular SAGD systems 100 may be encircled by an access road 808 and provided with electrical power from an electrical station 802. One or more products from the production modules 400 may be processed in a process area 804. An expansion module 806 may comprise a U shaped pipe, which may accommodate thermal expansion along the pipe rack 810 by reducing mechanical stress.

The configuration shown in FIG. 2 comprises the two well injection modules 200 being separate from the pipe rack modules 300 and placed in a perpendicular relationship to the pipe rack module 300. Other aspects may have a single injection module 200 being integrated with the pipe rack module 300 and/or placed in a parallel relationship to the pipe rack module 300. The production modules 400 may be placed in a perpendicular relationship to the pipe rack module 300 as shown or in a parallel relationship to the pipe rack module 300. Further details of these configurations are provided with reference to FIGS. 3A to 3C and FIGS. 4 to 6 below.

Figure 3A:
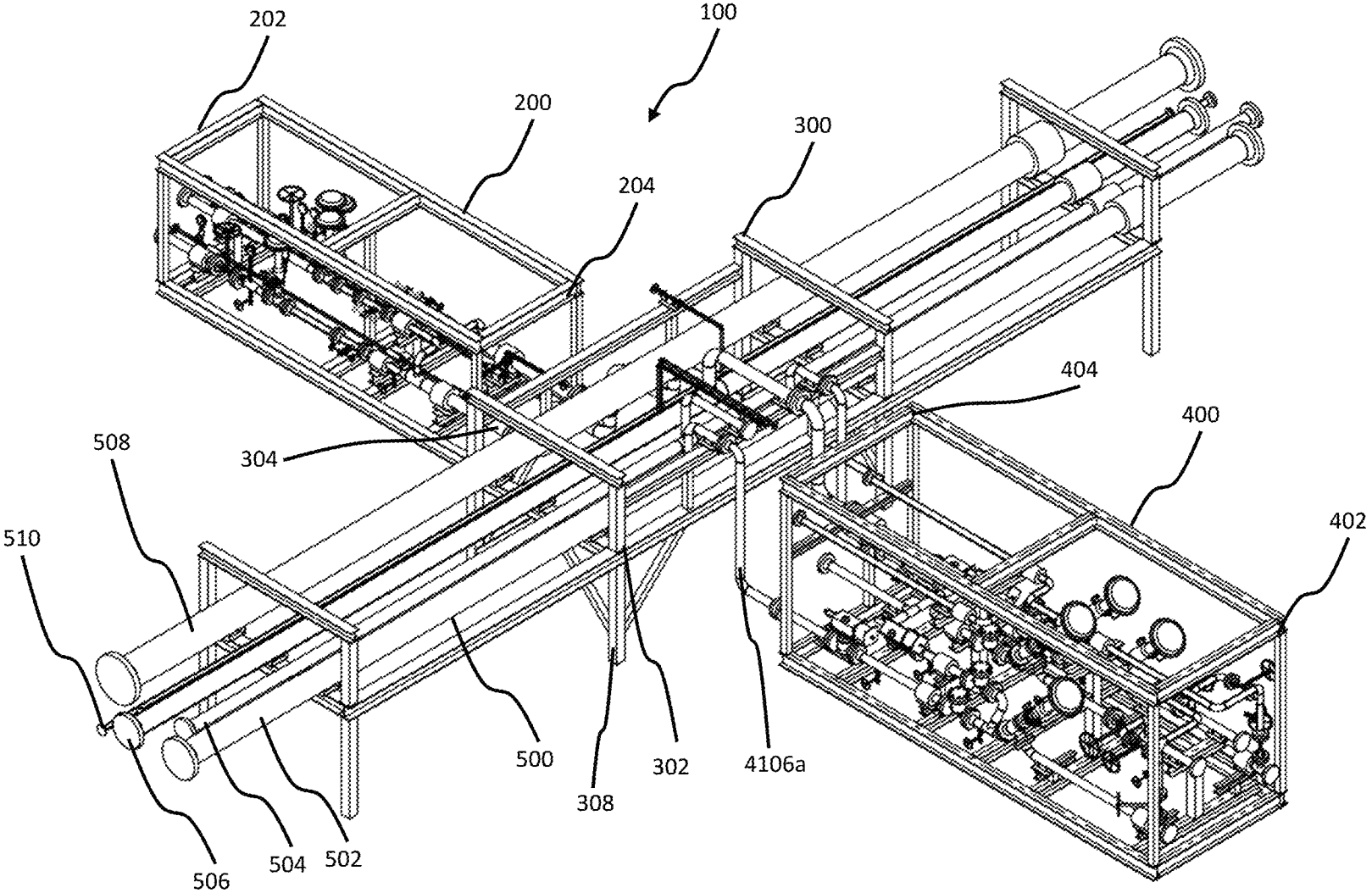
FIG. 3A is a perspective view of a first, two wellpair configuration having an injection module and a production module with a pipe rack module therebetween.
Figure 3B:
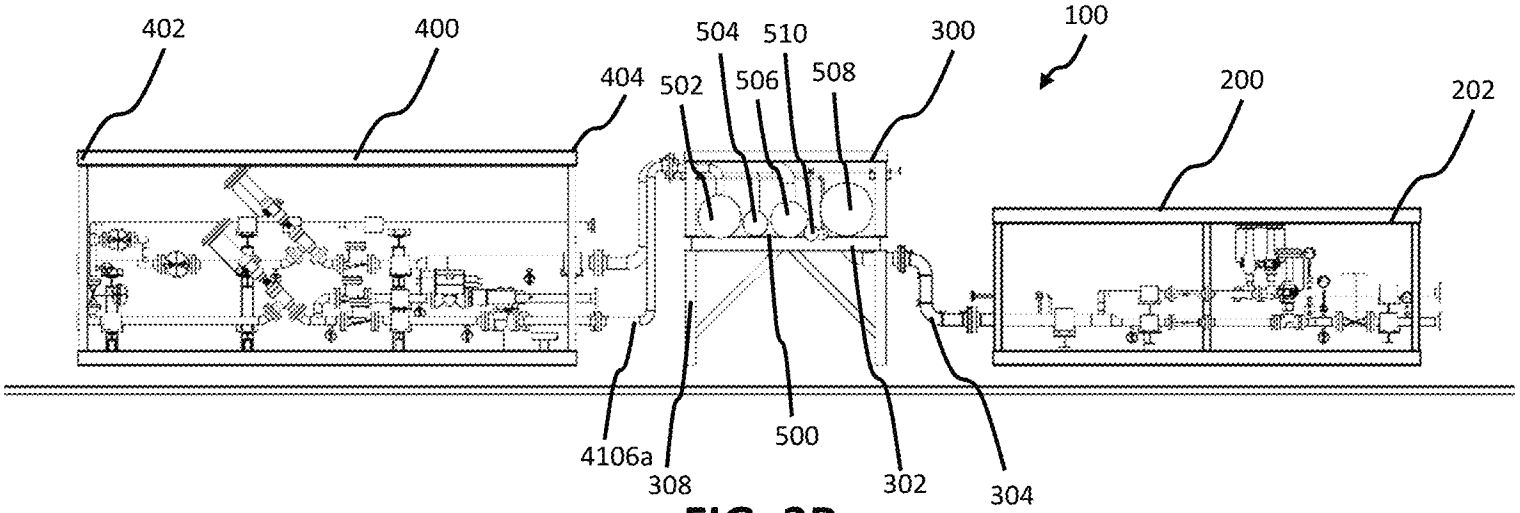
FIG. 3B is a right side view of the first, two wellpair configuration having the injection module and the production module with the pipe rack module therebetween.
Figure 3C:
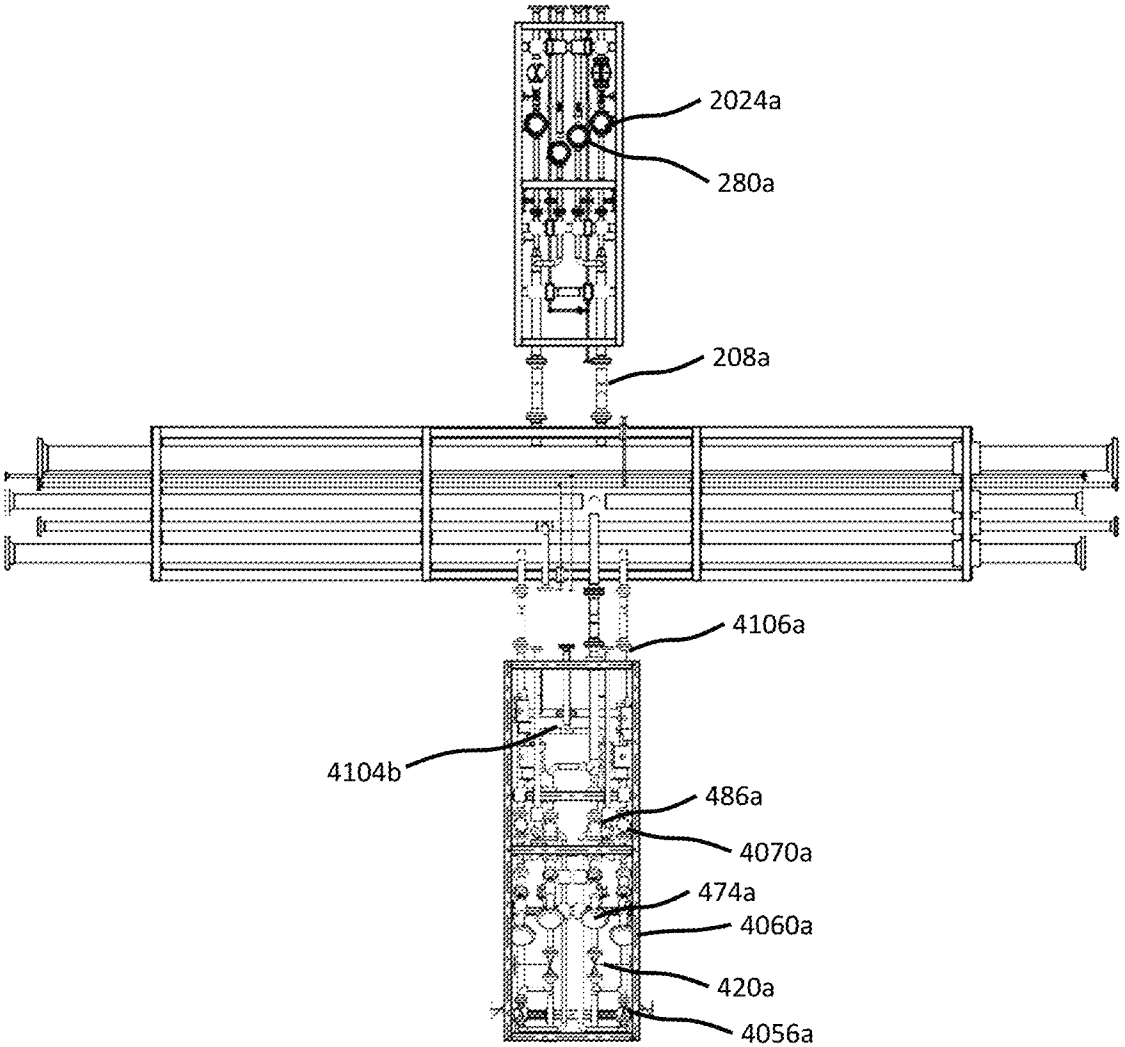
FIG. 3C is a top view of the first, two wellpair configuration having the injection module and the production module with the pipe rack module therebetween.

As shown in FIGS. 3A to 3C, the modular SAGD system 100 comprises the two well injection module 200, the pipe rack module 300, and the two well production module 400. The injection module 200 is described in further detail with reference to FIGS. 7A to 7D and FIG. 10 below. The production module 400 is described in further detail with reference to FIGS. 8A to 8D and FIG. 11 below. This first configuration of the modules 200, 300, 400 may reduce a total number of modules 200, 300, 400 and/or number of control panels. In this aspect, the SAGD system 100 may be configured to allow for two injector wells to be attached to the injection module 200. Likewise, the SAGD system 100 may be configured to allow for two production wells to be attached to the production module 400. In other aspects, the SAGD system 100 may be configured to allow for a single injector well to be attached to the injection module 200 and a single production well to be attached to the production module 400. This SAGD system 100 configuration may reduce an amount of piping to the wellheads 600, 700 as the piping to the wellheads 600, 700 may be mirrored versus replicated. The injection module 200 may be coupled on an injection well side 202 and coupled to a rack side 204 on the side opposite to the injection well side 202. Similarly, the production module 400 may be coupled to a production well side 402 and coupled to a rack side 404 on the side opposite to the production well side 402. The injection wellhead 600 and the production wellhead 700 are not shown in FIGS. 3A to 3C.

Figure 9:
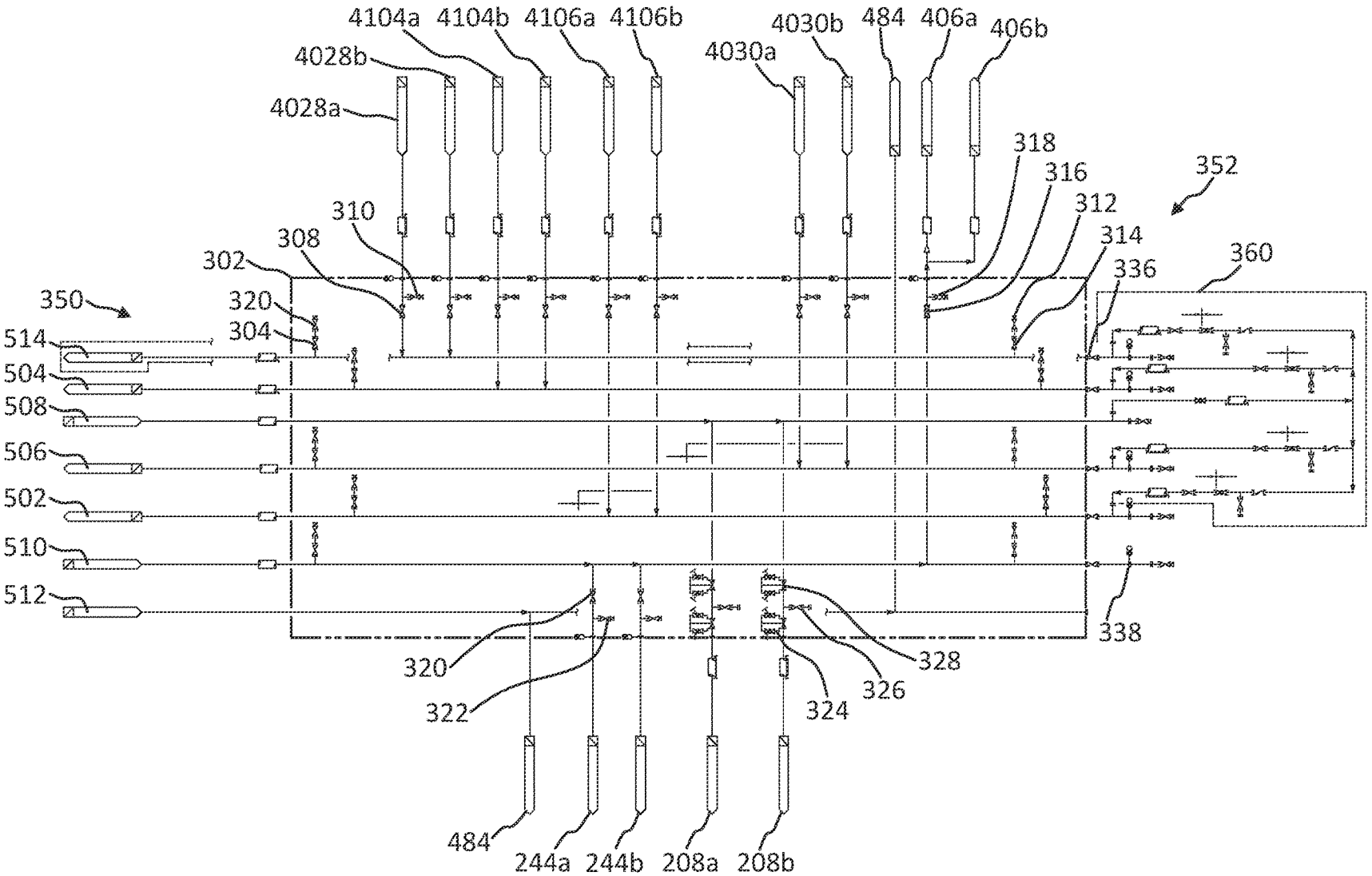
FIG. 9 is a schematic diagram of the pipe rack module.

The pipe rack module 300 may comprise a frame 302 enclosing one or more pipes 500 passing from one SAGD system 100 to another SAGD system 100. The frame 302 may provide one or more supports for each of the one or more pipes 500. In this aspect, the pipes 500 comprise an emulsion line 502, a test emulsion line 504, a produced gas line 506, a steam line 508, a fuel gas line 510, an instrument air line 512, and/or a test produced gas line 514 as shown in FIG. 9 in more detail. The frame 302 may comprise one or more legs 308 for maintaining the pipes 500 in an elevated position with respect to the injection module 200 and/or the production module 400. Within the frame 302, one or more injection couplings 304 and one or more production couplings 306 may couple to corresponding fittings within the injection module 200 and production module 400 respectively. The injection couplings 304 may comprise a steam coupling, a fuel gas coupling, and an instrument air coupling 484. The production couplings 306 may comprise an emulsion line coupling 4106, a test emulsion line coupling 4104, a production gas coupling 4030, a fuel gas coupling 406, and an instrument air coupling 484. One of more of these couplings 304, 306 may be attached and/or removed after certain phases of the well operation. These couplings 304, 306 may be described in further detail below.

Figure 4:
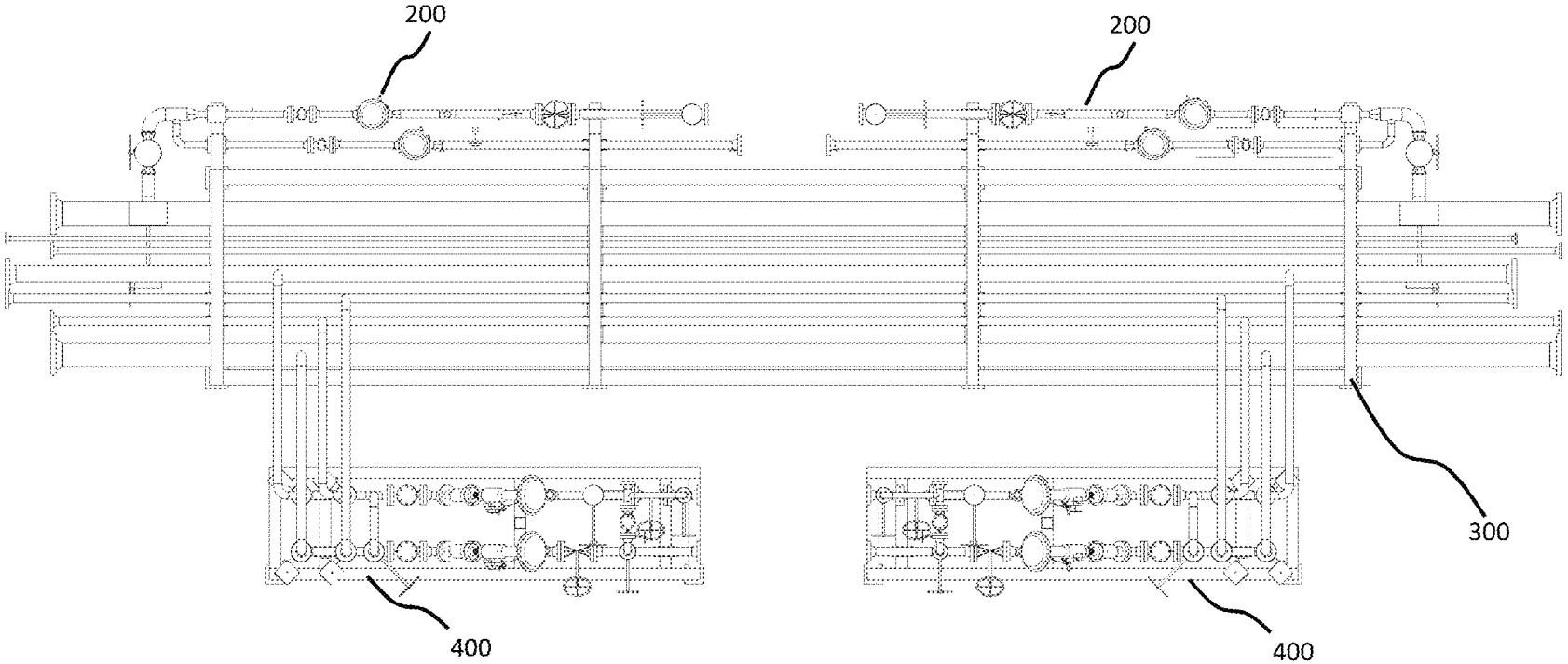
FIG. 4 is a top view of the second, two wellpair configuration having the mirrored pair of the injection modules and the mirrored pair of the production modules with the pipe rack module therebetween.

As shown in FIG. 4, a second configuration may comprise three modules (e.g. two of the production modules 400 and the pipe rack module 300, which has a pair of integrated injection modules 200) for a single double well-pair setup, or two modules (e.g. one of the production modules 400 and the pipe rack module 300, which has a single integrated injection module 200) for a single well-pair setup. The second configuration comprises a mirrored pair of the injection modules 200 integrated with the pipe rack module 300 and a mirrored pair of the production modules 400. The pipe rack module 300 may be between the mirrored pair of the integrated injection modules 200 and the mirrored pair of the production modules 400. The mirrored pair of the injection modules 200 may share a structural foundation with the pipe rack module 300. The second configuration may provide access to both sides of the injection modules 200 and/or production modules 400. The second configuration may allow for more flexibility while having smaller injection modules 200 and/or production modules 400 for easier shipment and/or installation. The second configuration may provide larger spacing from the wellheads 600, 700 allowing easier well head access. The second configuration may have a common support structure for the piping to the wellheads 600, 700.

In some aspects, the mirrored pair of the injection modules 200 may be integrated into the pipe rack module 300 for a single double well-pair setup, or three modules 200, 300, 400 for a single well-pair setup. The mirrored pair of the production modules 400 may be off of the integrated pipe rack module 300 permitting access to both sides of the production modules 400. The fourth configuration may have shared pipe supports and piles for the piping to the wellheads 600, 700.

Figure 5:
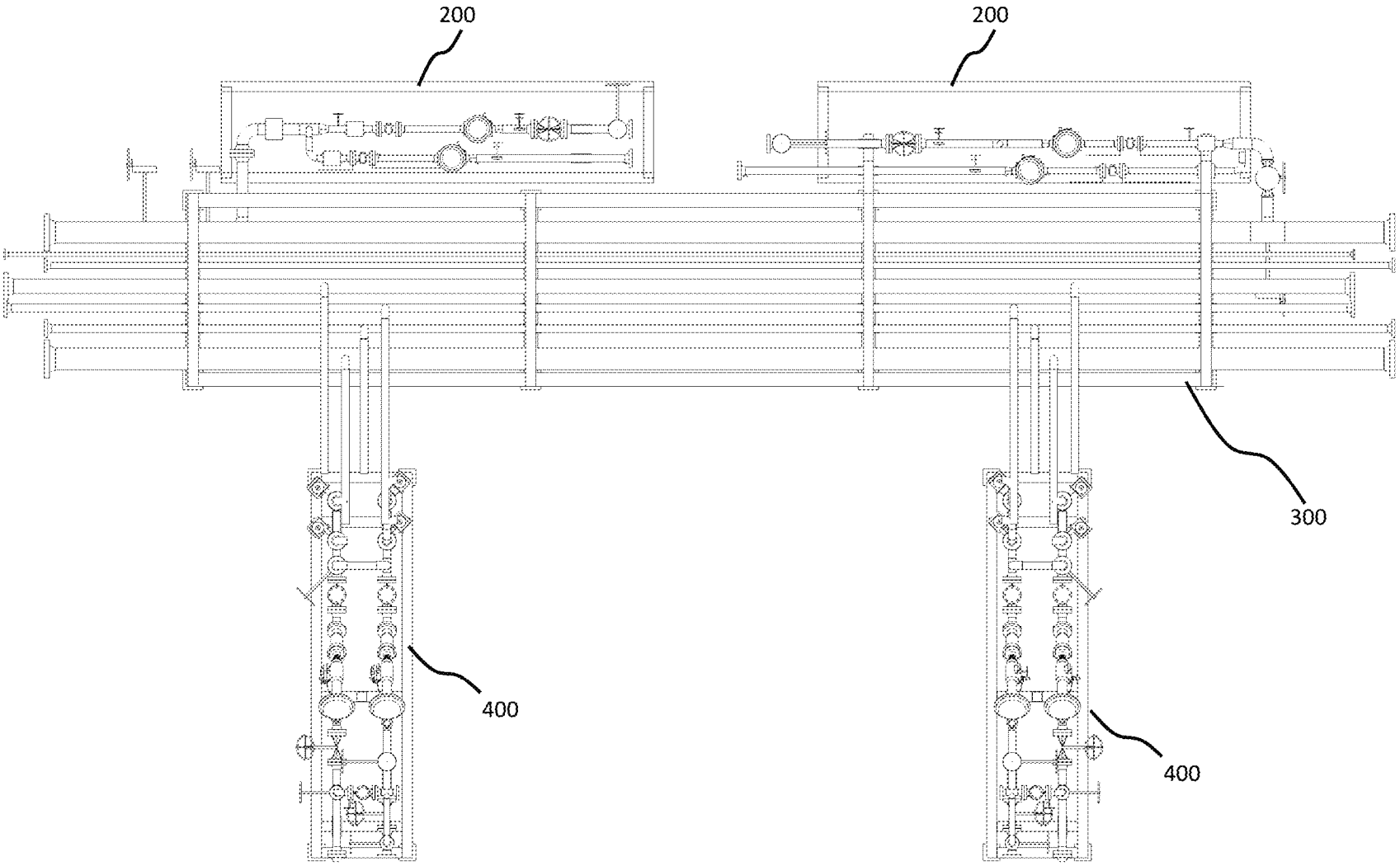
FIG. 5 is a top view of the third, two wellpair configuration having the mirrored pair of the injection modules and the identical pair of the production modules with the pipe rack module therebetween.

As shown in FIG. 5, a third configuration may also comprise five modules 200, 300, 400 for a single double well-pair setup, or three modules 200, 300, 400 for a single well-pair setup. The third configuration comprises the mirrored pair of the injection modules 200 as the second configuration. However, the third configuration comprises a mirrored pair of production modules 400. The pipe rack module 300 may be between the mirrored pair of the injection modules 200 and the mirrored pair of the production modules 400. The mirrored pair of the injection modules 200 may share a structural foundation. The third configuration may provide access to both sides of the injection modules 200. The third configuration may allow for more flexibility while having smaller injection modules 200 for easier shipment and/or installation. The third configuration may reduce the piping necessary from the mirrored pair of the production modules 400 to the wellheads 700.

Figure 6:
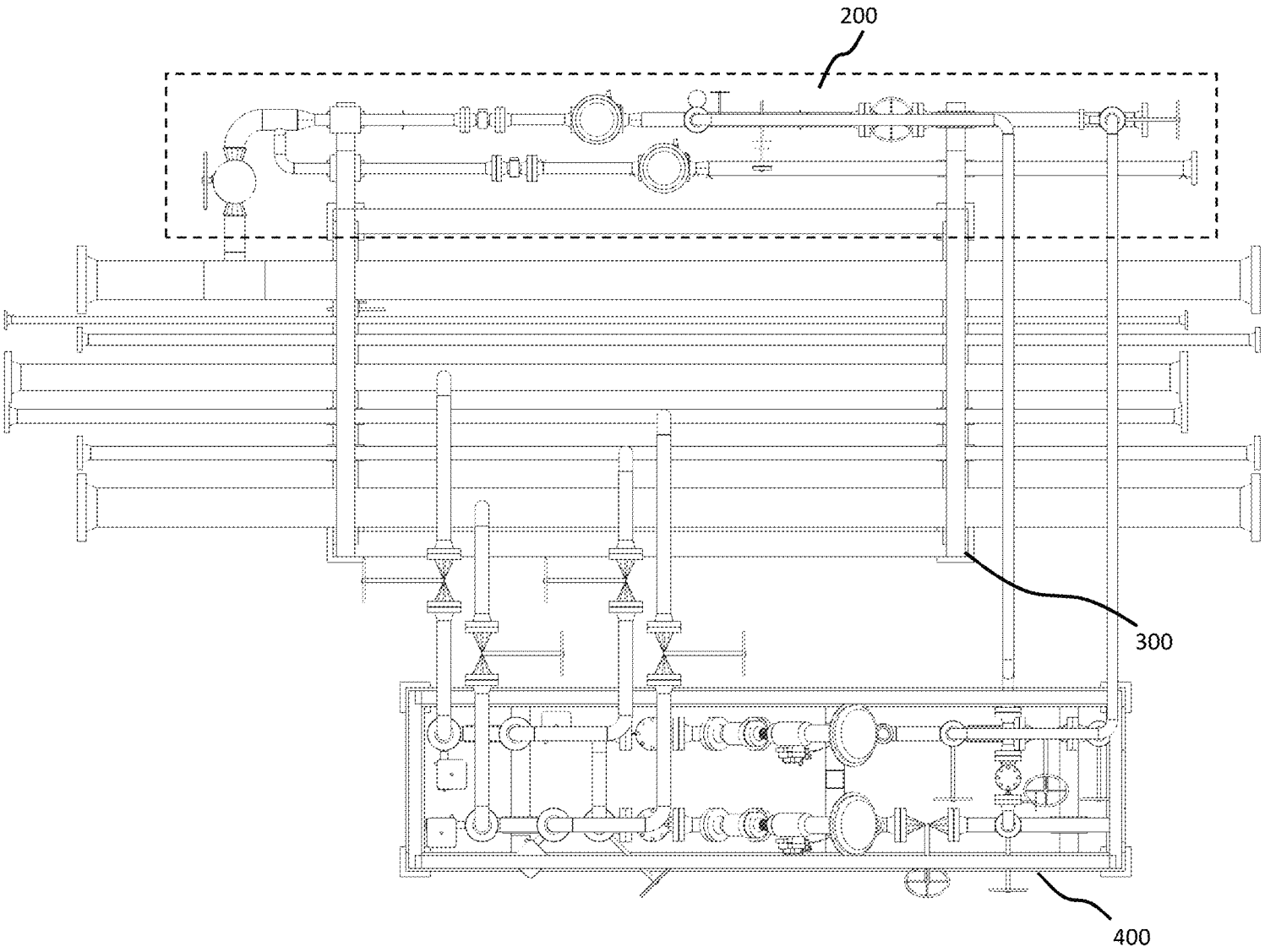
FIG. 6 is a top view of the fourth, single wellpair configuration having the injection module integrated with the pipe rack module and the production module off of the pipe rack module.
Figure 7A:
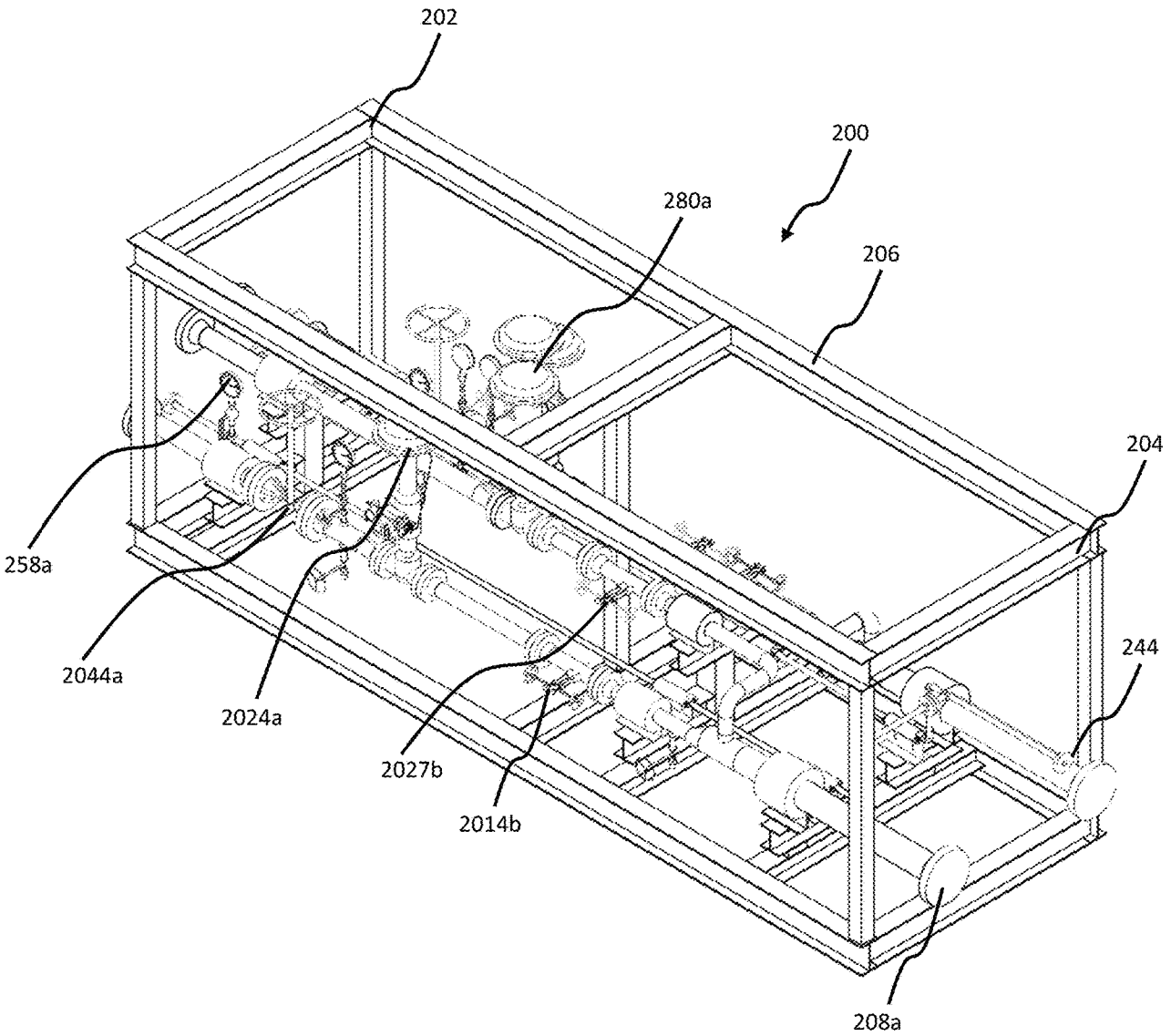
FIG. 7A is a perspective view of the two well injection module.
Figure 7B:
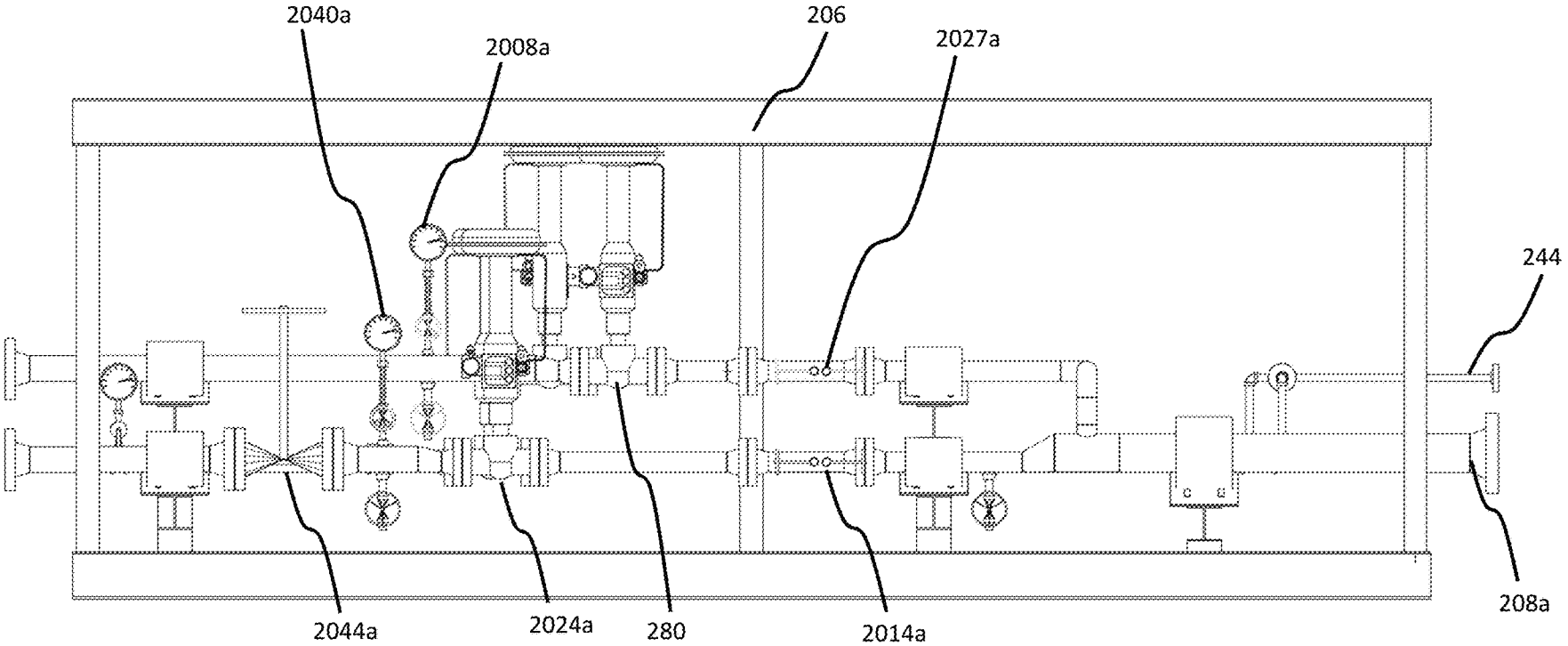
FIG. 7B is a left side view of the two well injection module.
Figure 7C:
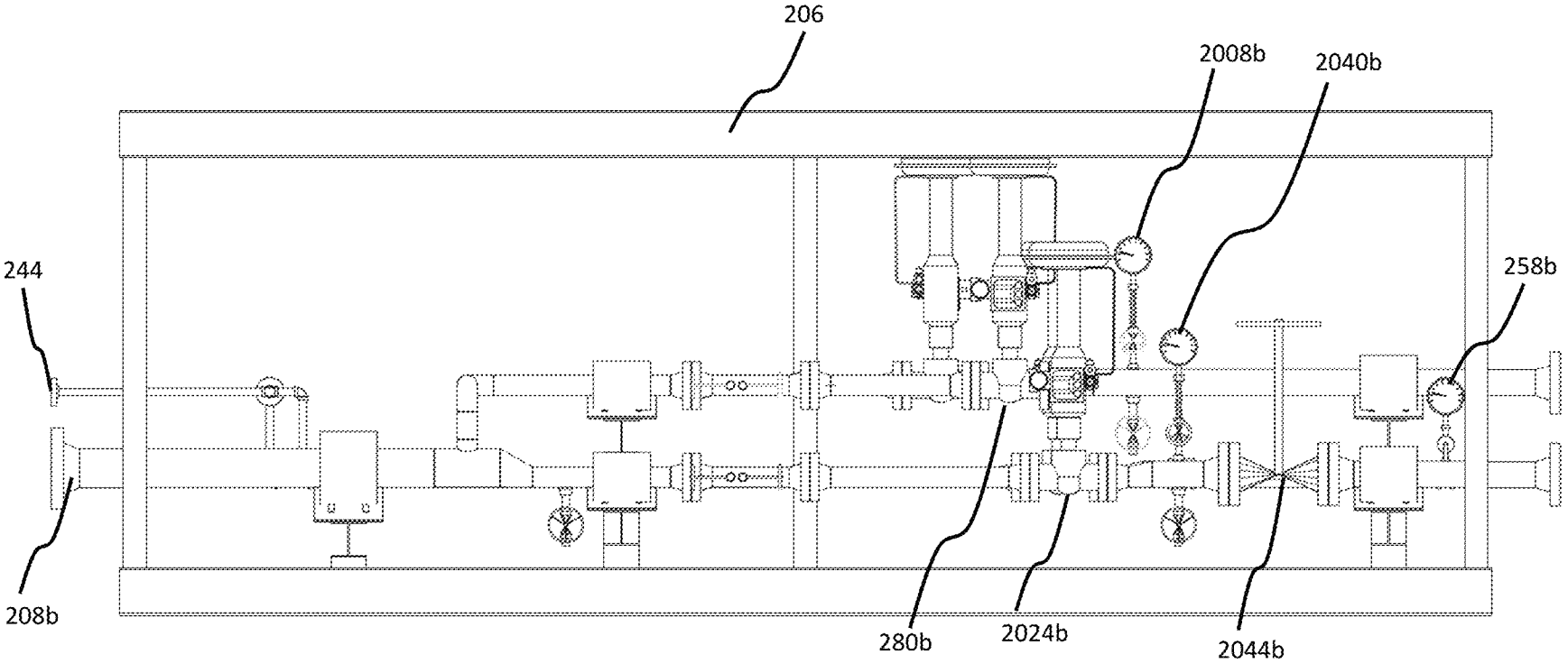
FIG. 7C is a right side view of the two well injection module.
Figure 7D:
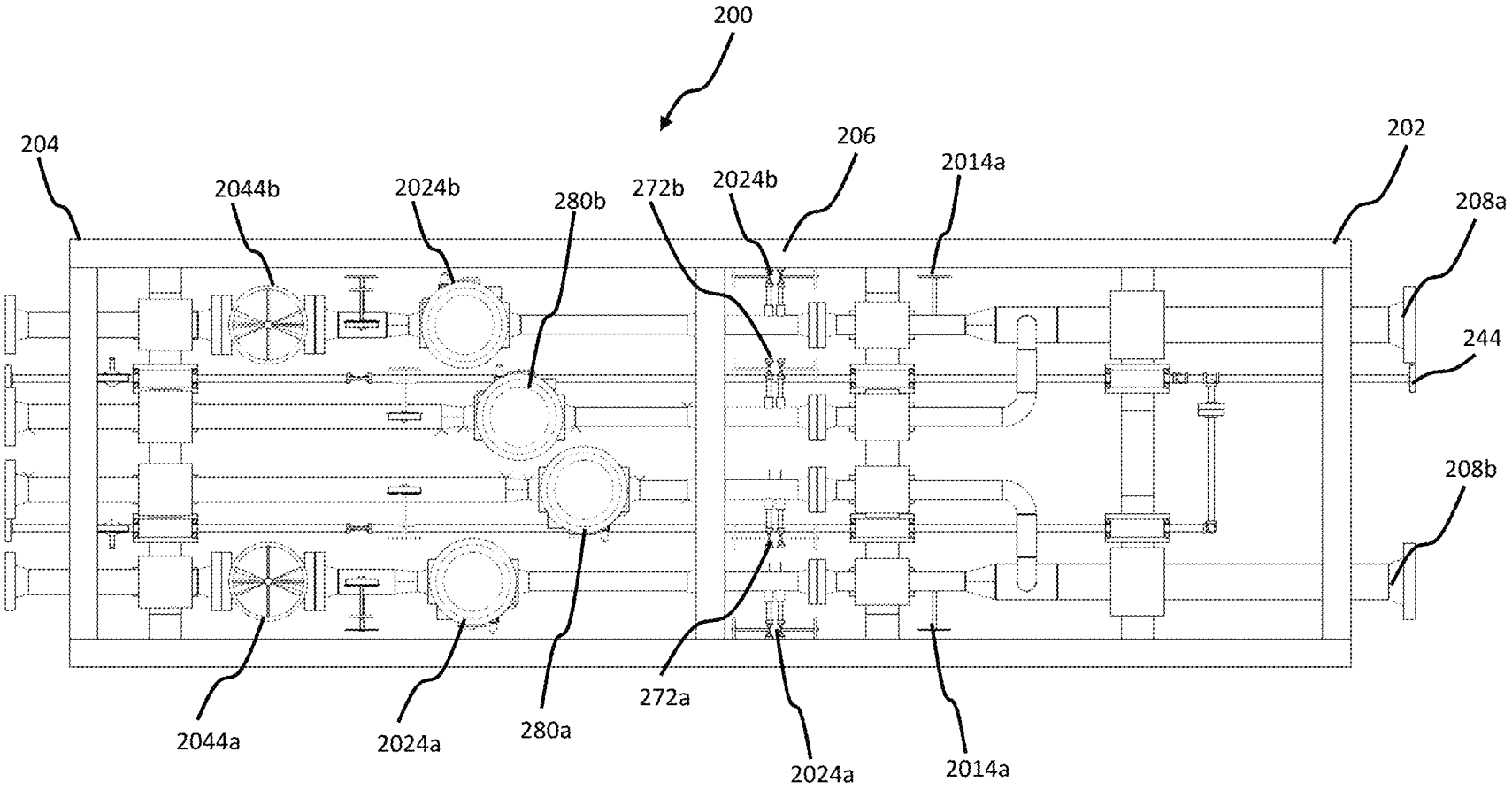
FIG. 7D is a top view of the two well injection module.
Figure 8A:
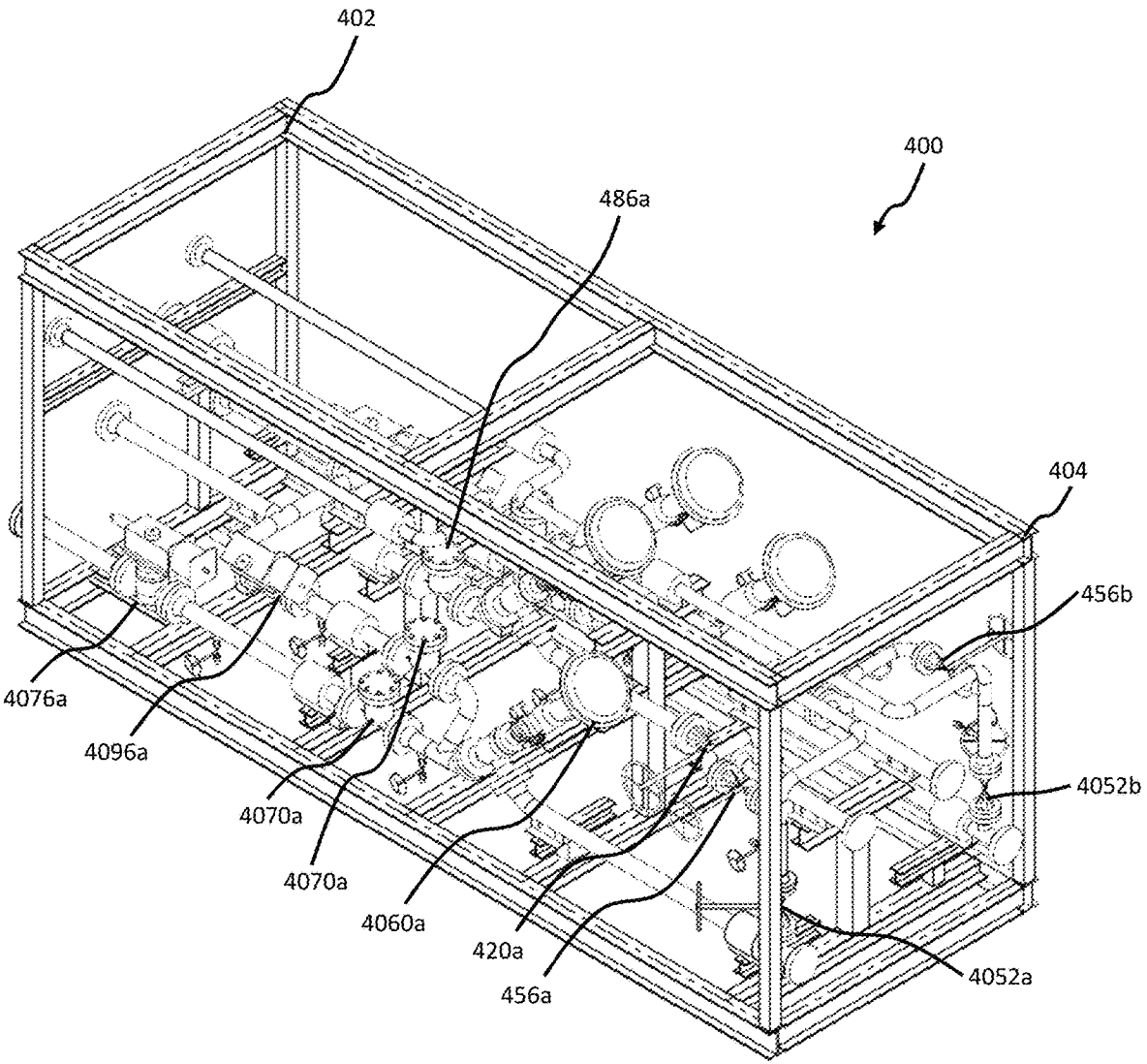
FIG. 8A is a perspective view of the two well production module.
Figure 8B:
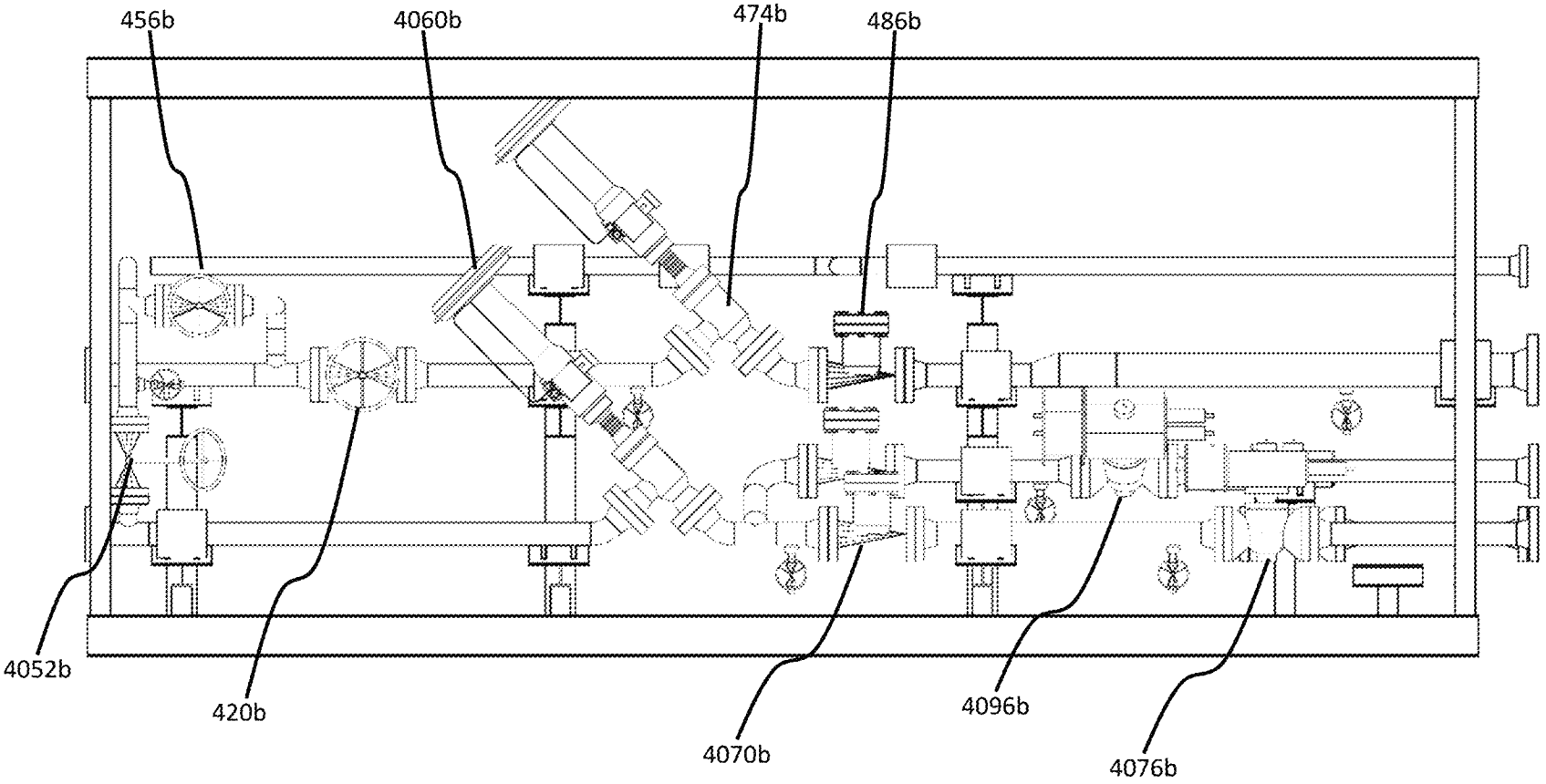
FIG. 8B is a left side view of the two well production module.
Figure 8C:
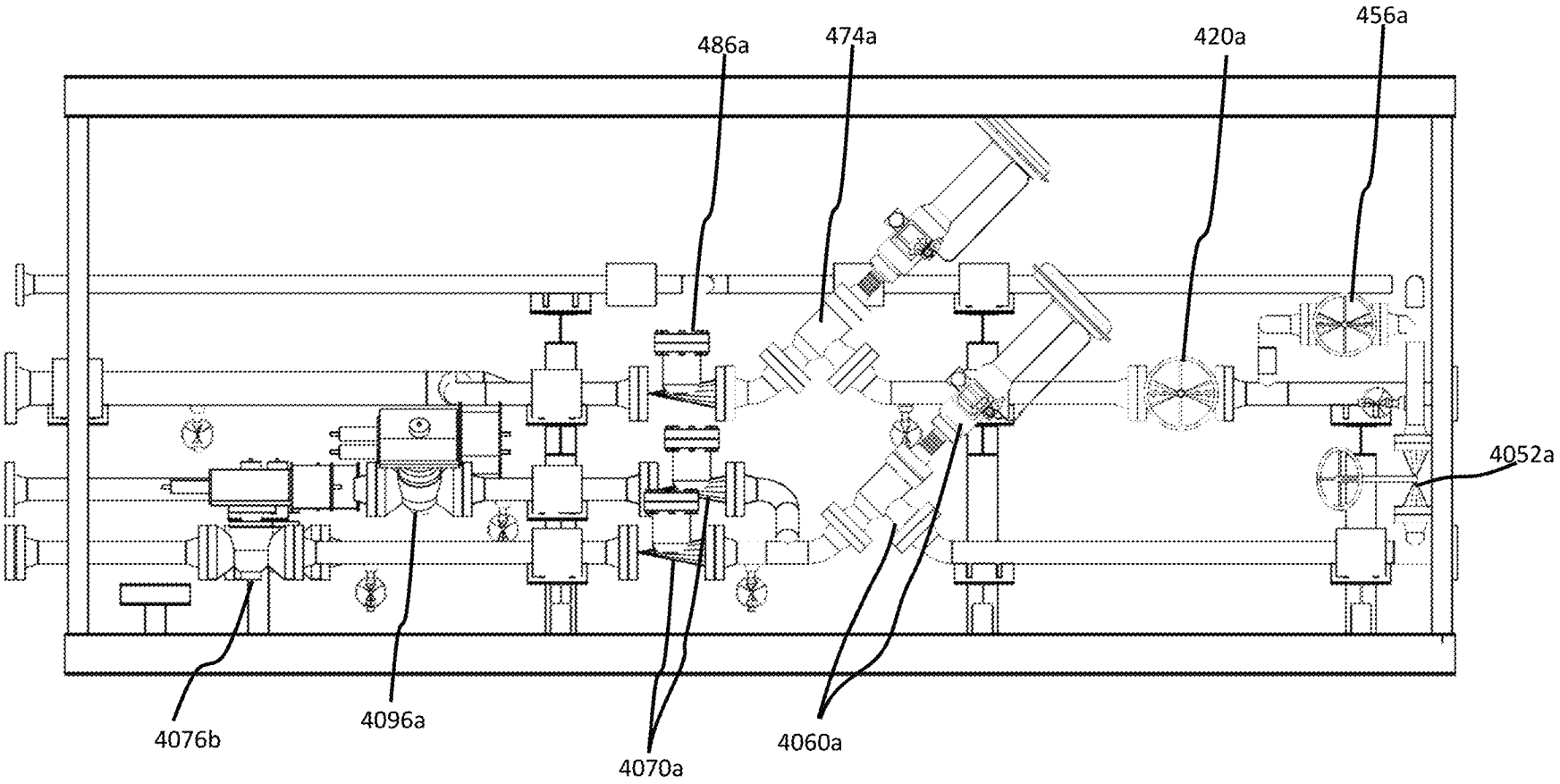
FIG. 8C is a right side view of the two well production module.
Figure 8D:
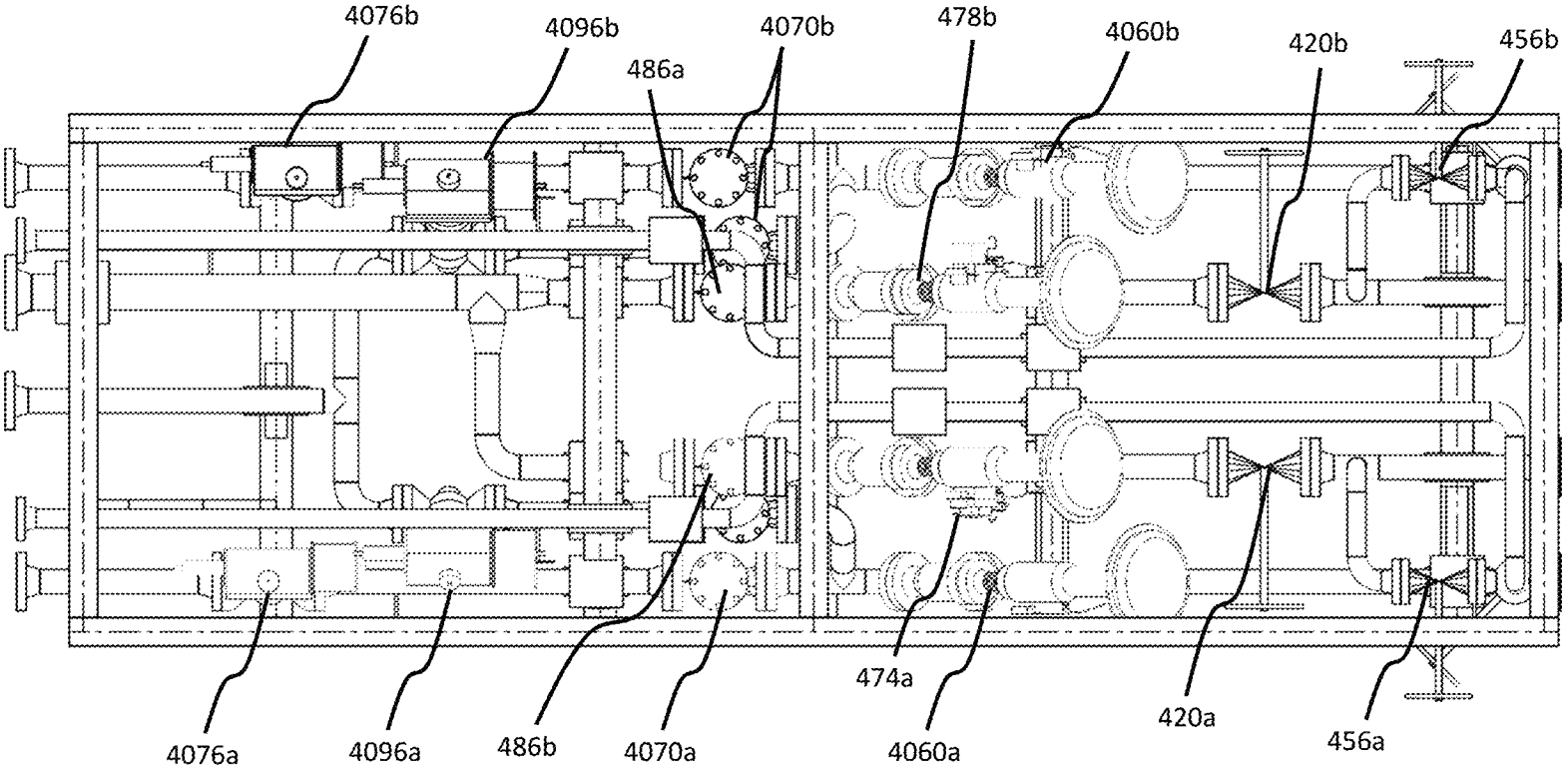
FIG. 8D is a top view of the two well production module.

Turning to FIG. 6, a fourth configuration may comprise the injection module 200 integrated into the pipe rack module 300 for a single well-pair setup. The production module 400 may be off of the integrated pipe rack module 300. The production modules 400 may be oriented along or parallel to the pipe rack module 300. A pair of the fourth configuration (e.g. a pair of identical pair of injection modules 200, an identical pair of production modules 400) may be used for a two well-pair setup. The piping to the wellheads 600, 700 may be separated in the fifth configuration thereby requiring more pipe supports and/or piling. Nevertheless, the fifth configuration may require less steel than compared to the other configurations.

As shown in FIG. 9, the pipe rack module 300 comprises one or more couplings for each of the pipes 500. The steam line 508, the fuel gas line 510, and the instrument air line 512 provide their respective inputs to the injection module 200 and/or the production module 400 respectively. The emulsion line 502, the test emulsion line 504, the produced gas line 506, and the test produced gas line 514 may provide respective outputs from the production module 400.

The test produced gas line 514, the test emulsion line 504, the produced gas line 506, the emulsion line 502, and/or the fuel gas line 510 may each have a gate valve 304 branching off of their respective lines 502, 504, 506, 510, 514 at a head end 350 of the pipe rack module 300. Only one set of the valves 320, 304 in FIG. 9 are numbered in order to improve clarity. The valve 320 may be a globe valve, while the valve 304 may be a gate valve. The gate valve 304 may act as an on/off function, while the globe valve 320 may gradually open and/or close to bleed off pressure. The combination of these valves 304, 320 may reduce failure of the gate valve 304. When the globe valve 320 fails, the gate valve 304 may be closed to facilitate replacement of the globe valve 320. Similarly, the test produced gas line 514, the test emulsion line 504, the produced gas line 506, the emulsion line 502, and/or the fuel gas line 510 may each have a gate valve 314 branching off of their respective lines 502, 504, 506, 510, 514 at a tail end 352 of the pipe rack module 300. The valve 312 may be a globe valve, while the valve 314 may be a gate valve. The gate valve 314 may act as an on/off function, while the globe valve 312 may gradually open and/or close to bleed off pressure. The combination of these valves 314, 312 may reduce failure of the gate valve 314. When the globe valve 312 fails, the gate valve 314 may be closed to facilitate replacement of the globe valve 312. Each of the lines 502, 504, 506, 510, 514 may have a gate valve 336 in series with their respective line 502, 504, 506, 510, 514 to isolate one pipe rack module 300 from another pipe rack module 300. Following each of these isolation gate valves 336 may be a spectacle blind 338.

As previously mentioned, the production couplings 306 may comprise the emulsion line coupling 4106, the test emulsion line coupling 4104, the production gas coupling 4030, the fuel gas coupling 406, and the instrument air coupling 484. Prior to connecting to the main pipes 500, each of the emulsion line coupling 4106, the test emulsion line coupling 4104, and/or the production gas coupling 4030 may comprise a bleed valve 310 and a gate valve 308. Again to improve clarity, only one set of the bleed valve 310 and the gate valve 308 are labeled in FIG. 8. The fuel gas coupling 406 may have a bleed ball valve 318 and a ball valve 316. In some aspects, the instrument air coupling 484 may not have the bleed valve 310 and the gate valve 308.

Figure 9B:
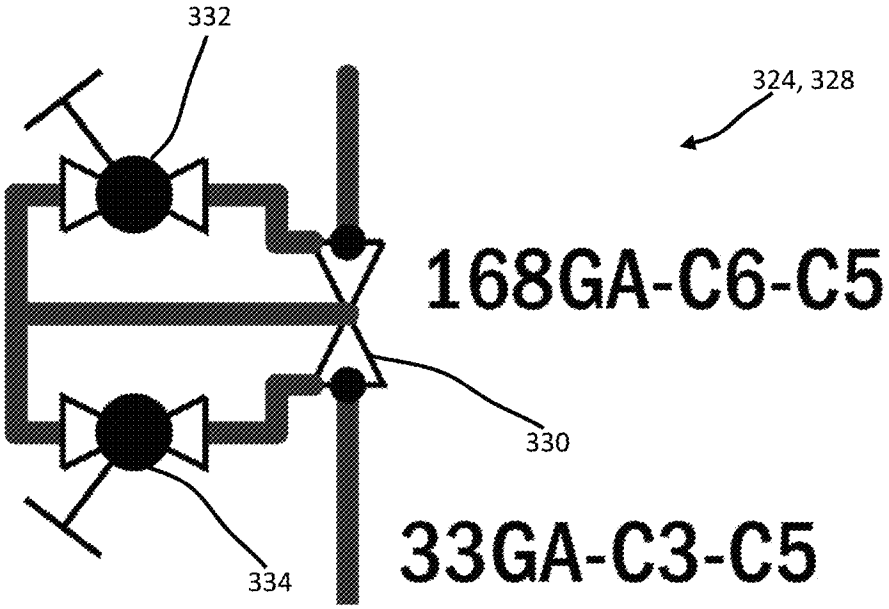
FIG. 9B is an enlarged view of a pressure reducing system of the pipe rack module.
Figure 10:
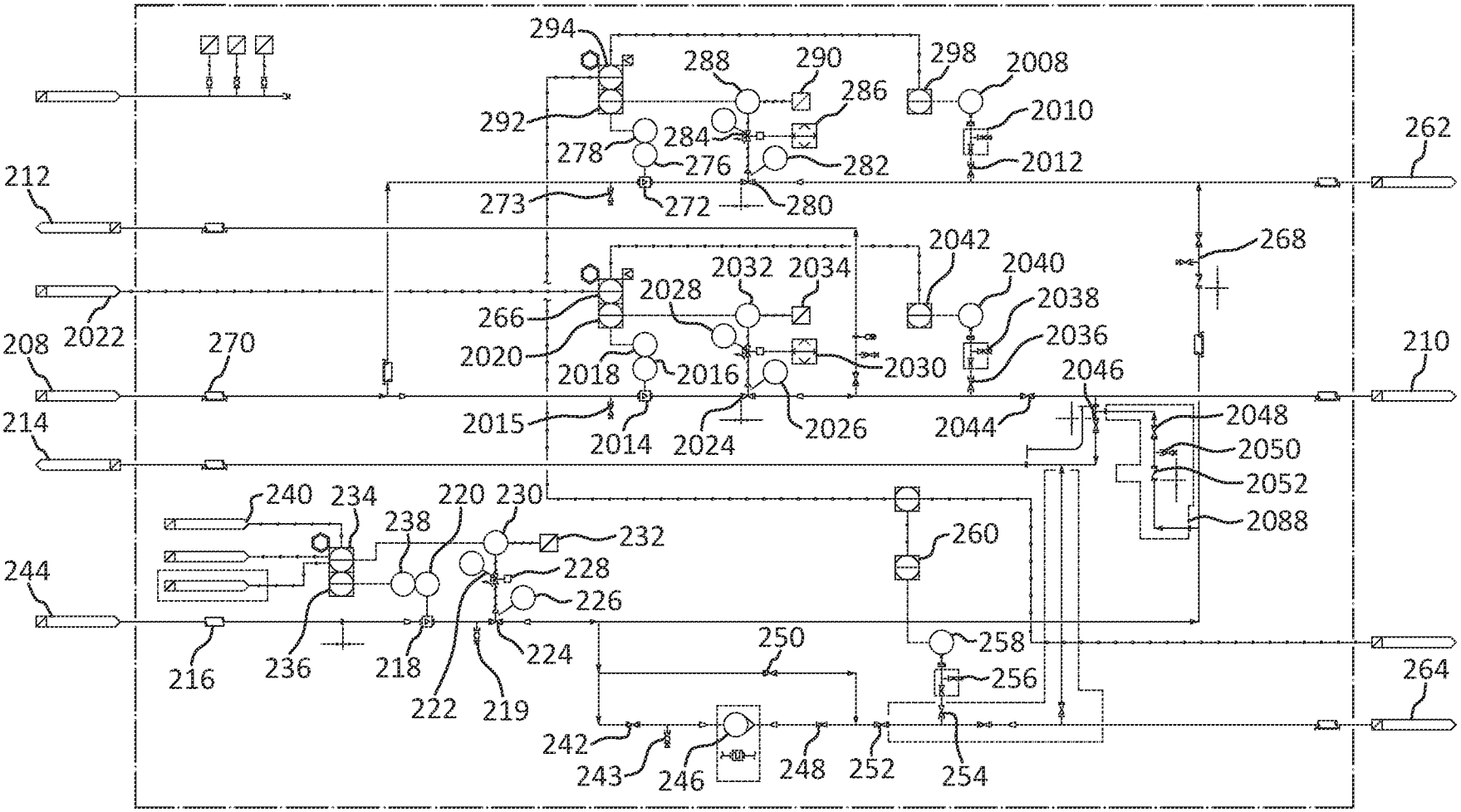
FIG. 10 is a schematic diagram of the single well injection module.
Figure 11:
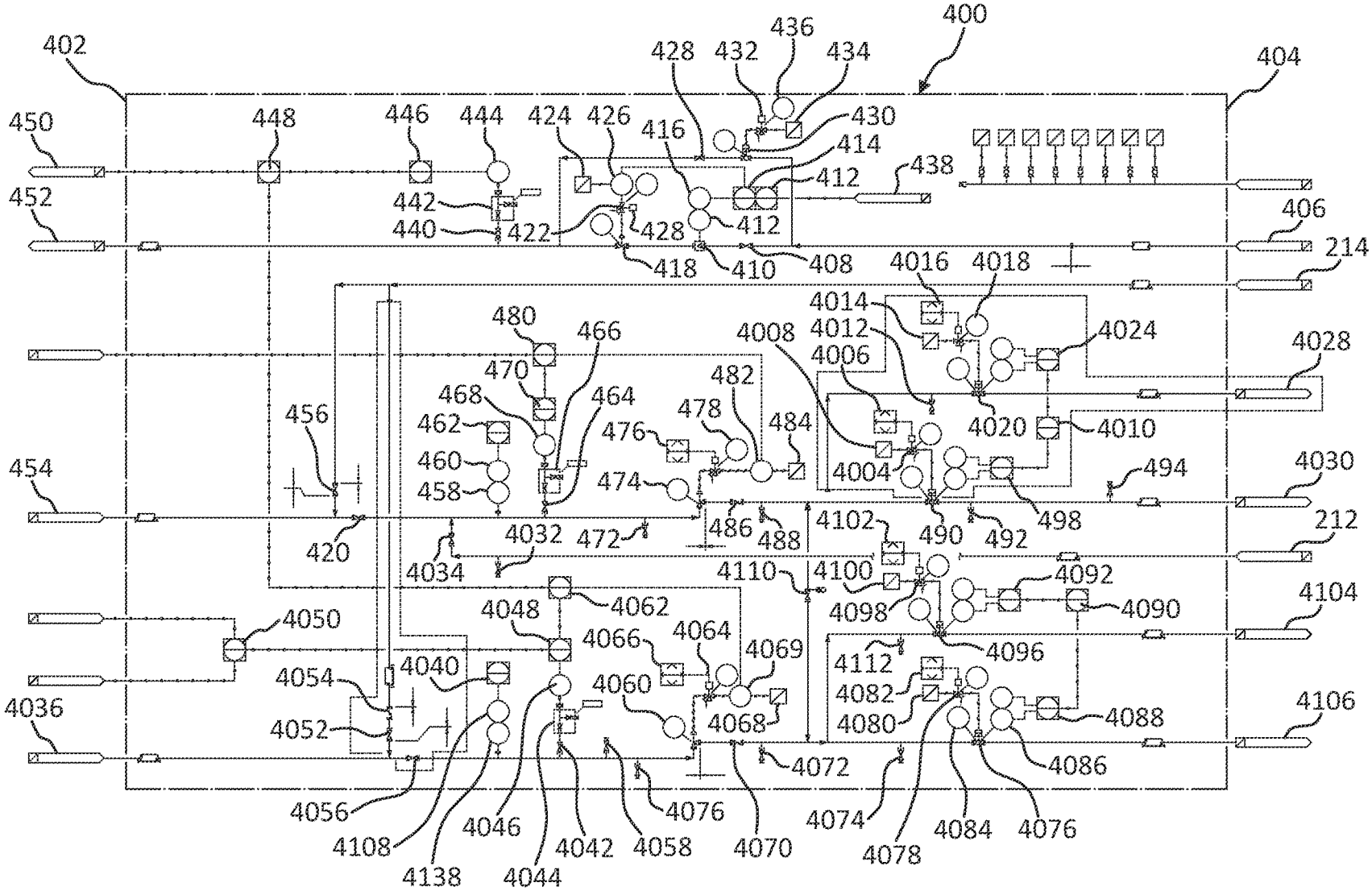
FIG. 11 is a schematic diagram of the single well production module.

As previously mentioned, the injection couplings 304 may comprise the steam coupling 208, the fuel gas coupling 244, and the instrument air coupling 484. The fuel gas coupling 244 may have a bleed valve 322 and a gate valve 320. The high pressure steam coupling 208 may comprise one or more pressure reduction systems 324, 328. The pressure reduction system 324, 328, shown in greater detail in FIG. 9B, may comprise a gate valve 330. The gate valve 330 may have a hand-operated globe valve 332 branching off an inlet of the gate valve 330. Following the globe valve 332, the flow returns to the gate valve 330 and branches to a second hand-operated globe valve 334 off an outlet of the gate valve 330. In operation, the pressure reduction system 324, 328 may reduce the pressure from the high pressure steam line to the injection module 300. A pressure reduction may be adjusted and/or determined by increasing or decreasing a flow through each of the globe valves 332, 334. In this aspect, the high pressure steam coupling 208 may comprise a pair of pressure reduction systems 324, 328 placed in series in order to step the pressure down twice. Other aspects may have more or less pressure reduction systems 324, 328 depending on the pressure in the high pressure steam line. In between the pressure reduction systems 324, 328 may be a release valve 326.

According to some aspects, there may be a steam sweep module 360 at the end of the pipe rack modules 300. The steam sweep module 360 enables the high pressure steam to be fed into the test produced gas line 514, the test emulsion line 504, the produced gas line 506, the emulsion line 502, and/or the fuel gas line 510.

In this aspect, the production module 400 may be configured for a pair of production wellheads. In FIG. 8, each of the lines are labeled with an "a" or "b" to denote whether the couplings 306 are associated with production wellhead "a" or "b". For example, the emulsion line coupling 4106*a* is associated with production wellhead "a" and the emulsion line coupling 4106*b* is associated with production wellhead "b". A common instrument air coupling 484 may be used for both of the production wellheads. Similarly, the injection module 200 may be configured for a pair of injection wellheads where each of the lines are labelled with an "a" or "b" to denote whether the couplings 304 are associated with injection wellhead "a" or "b".

Turning to FIGS. 7A to 7D and 10, the injection module 200 may be described in further detail. The injection module 200 may comprise a frame 206 to facilitate moving the injection module 200. Fuel gas and high pressure steam may be provided to the injection module 200 by a high pressure steam header 208 and a fuel gas header 244. Circulation steam 214 and circulation returns 212 may be provided to the production module 400. The fuel gas line 216 may be insulated or not insulated. The fuel line 216 may start at, for example, a diameter at the fuel gas header 244 of 60-inches and may be reduced to 33-inches before reaching a vortex flow meter 218*a* coupled to a flow indicator 220 and a bleed valve 219 and/or flow transmitter 238. The flow transmitter 238 may transmit a measured fuel flow signal to a flow controller 236.

A spring and diaphragm actuator 224 may follow the flow meter 218. The spring and diaphragm actuator 224 may comprise a flow regulator 226. The diaphragm from the spring and diaphragm actuator 224 may receive a pneumatic signal from a three-way solenoid valve 222. An interlock 228 may control the three-way solenoid valve 222 to provide the pneumatic signal to atmosphere or to a flow converter 230 that may convert the pneumatic signal to an electrical signal for transmitting to a flow quantity indicator 234. The flow quantity indicator 234 may transmit the flow measurements via one or more data links 240. The flow converter 230 may also receive the pneumatic signal from instrument air 232.

Following the spring and diaphragm actuator 224, the fuel line 216 may increase in diameter from 33-inches back to 60-inches and then may branch into three branches. Two of the branches may produce fuel gas to a fuel gas output 264 to the injection well. One of these branches may comprise a gate valve 242*a* with a bleed 242*b*. In some aspects, a variable area flow indicator and/or a Coriolis flow meter 246 may be placed in the flow. This branch may terminate with another gate valve 248. A bypass valve 250 may be on the second branch to bypass the flow indicators 246. These two branches may merge together before another gate valve 252. Following the gate 252, the main fuel line 216 may have a hose branch with a hose gate 254 leading to a needle valve device 256. The needle valve device 256 may comprise a needle valve receiving a pressure from the main fuel line 216. A pressure transmitter 258 may convert the pressure into an electrical signal for transmission to a pressure indicator 260 and/or a flow quantity indicator 266. The needle valve device 256 may allow an operator to confirm no pressure is trapped between valve 254 and the pressure transmitter 258 in the event that the pressure transmitter 258 needs to be replaced.

The third branch may provide fuel gas to a long string high pressure steam 262 via a check valve with a bleed and a gate valve 268.

Returning to the high pressure steam header 208, an insulated high pressure steam line 270 may have a diameter of 168-inches. The high pressure steam line 270 may branch into the long-string high-pressure steam output 262 and a short-string high-pressure steam output 210, both of which may be provided to the injection well. The diameter of the insulated high pressure steam line 270 may be reduced from 168-inches to 89-inches. The long string branch may have a bleed ring 272*a* followed by a vortex flow meter 272*b* with a flow indicator 276. The measured flow may be converted using a flow transmitter 278 into an electrical signal provided to a flow controller 292.

Following the flow measurement, the long string branch may comprise a spring and diaphragm actuator 280 may comprise a flow regulator 282. The diaphragm from the spring and diaphragm actuator 280 may receive a pneumatic signal from a three-way solenoid valve 284. An interlock 286 may control the three-way solenoid valve 284 to provide the pneumatic signal to atmosphere or to a flow converter 288 that may convert the pneumatic signal to an electrical signal for transmitting to a flow quantity indicator 294. The flow quantity indicator 294 may transmit the flow measurements via one or more data links 296. The flow converter 288 may also receive the pneumatic signal from instrument air 232.

Following the spring and diagram actuator 280, the long string branch may expand in diameter to 114-inches. Following the expansion, the long string branch may have a hose branch with a hose gate 2012 leading to a pressure sampler 2010. The pressure sampler 2010 may comprise a needle valve receiving a pressure from the long string branch. A pressure transmitter 2008 may convert the pressure into an electrical signal for transmission to a pressure indicator 298 that may transmit an override signal over a datalink to the flow quantity indicator 294. Once a pressure has been measured, the pressure sampler 256 may vent to atmosphere. The third branch of the fuel string may provide fuel gas to the long string high pressure steam 262 via a check valve with a bleed and a gate valve 268. In some aspect, a similar configuration 2088 may provide fuel gas to the short string high pressure steam 210 via a check valve with a bleed and gate valve 2088.

Turning to the short string branch, the short string branch may have a bleed valve 2015 followed by a vortex flow meter 2014 with a flow indicator 2016. The measured flow may be converted using a flow transmitter 2018 into an electrical signal provided to a flow controller 2020.

Following the flow measurement, the short string branch may comprise a spring and diaphragm actuator 2024 may comprise a flow regulator 2026. The diaphragm from the spring and diaphragm actuator 2024 may receive a pneumatic signal from a three-way solenoid valve 2028. An interlock 2030 may control the three-way solenoid valve 2028 to provide the pneumatic signal to atmosphere or to a flow converter 2032 that may convert the pneumatic signal to an electrical signal for transmitting to a flow controller 2020. The flow quantity indicator 266 may transmit the flow measurements via one or more data links 2022. The flow converter 2032 may also receive the pneumatic signal from the instrument air 2034.

Following the spring and diagram actuator 2024, the short string branch may expand in diameter to 114-inches. Following the expansion, a branch may occur. A circulation steam branch may divert circulation steam to the production module 400 through a gate valve 2048 with a bleed 2050 and an open spectacle blind 2052. An output branch may comprise a hose branch with a hose gate 2036 leading to a pressure sampler 2038. The pressure sampler 2038 may comprise a needle valve receiving a pressure from the short string branch. A pressure transmitter 2040 may convert the pressure into an electrical signal for transmission to a pressure indicator 242 that may transmit an override signal over a datalink to the flow quantity indicator 266. Once a pressure has been measured, the pressure sampler 2038 may vent to atmosphere.

Following the pressure sampler 2038, another gate valve 2044 may be placed in series prior to a branch. One leg of the branch may lead directly to the short string high pressure output 210 to the injection well. During a brief period, the injection well may provide emulsions returned to the surface which may be via the short string high pressure output 210 of the injection module 200. These emulsions may be diverted to the production module 400. The other leg of the branch may be a circulation injection 212 to the production module 400. The circulation injection 212 may comprise a gate valve 2046.

Turning to FIGS. 8A to 8D and 11, the production module 400 may be provided with a bubble gas from a fuel gas header 406. The bubble gas line may be insulated and may have a diameter of 33-inches. The bubble gas line may break into two branches. The first branch may comprise a gate valve 408 followed by a vortex flow meter 410. Both the gate valve 408 and the flow meter 410 may be placed in a flanged configuration with the bubble gas line. A measured flow from the vortex flow meter 410 may be converted using a flow transducer 416 into an electrical signal to be received by a flow controller 414 with a flow quantity indicator 412. The flow quantity indicator 412 may transmit the flow quantity via a data link 438.

In some aspects, following the vortex flow meter 410 may be a spring and diaphragm actuator 418 also placed in a flanged configuration with the bubble gas line. The spring and diaphragm actuator 418 may be controlled by a three way solenoid valve 422. The solenoid valve 422 may in turn be controlled by an interlock 428. A pneumatic signal may be supplied by instrument air 424 to the diaphragm of the spring and diaphragm actuator 418 in order to control the flow of bubble gas therethrough. A flow measurement of the instrument air 424 may be transmitted by electrical signal to the flow controller 414 by a flow transducer 426.

The second branch may have a ball valve 430 with a quarter turn actuator. The actuator may receive a pneumatic signal from a solenoid valve 436 supplied by industrial air 434 and controlled by an electrical signal from an interlock 432. Following the ball valve 430 may be a needle valve 428 threaded in line with the branch. The flow from this branch may then rejoin the previously described branch.

Following the merging of the two branches, a pressure of the bubble gas may be measured prior to the bubble gas 452 being supplied to the production well. A ball valve 440 may be socket welded off of the bubble gas line. The ball valve 440 may enable and/or disable the measurement of the pressure and/or facilitate replacement of the remaining pressure measurement elements. Following the ball valve 440, the pressure sampler 442 may comprise a needle valve receiving a pressure from the bubble gas line. A pressure transmitter 444 may convert the pressure into an electrical signal for transmission to a pressure indicator 446. A temperature indicator 448 may also provide an electrical signal corresponding to the temperature to the pressure indicator 446. The pressure and/or temperature may then be transmitted via a short string steam data link 450. Once a pressure has been measured, the pressure sampler 442 may vent to atmosphere via a second needle valve.

Produced gas 454 may be received from the production well by the production module 400 via a production gas line. The production gas line may have a diameter of 114-inches and/or may be insulated. Circulation steam 214 from the injection module 200 may be introduced into the production gas near the production side 402 of the production module 400. The circulation steam 214 may be introduced by a gate valve 456 during a circulation phase. A gate valve 420 in a flanged configuration may be placed following the introduction of the circulation steam 214, which is closed during the circulation phase. During the circulation phase, the produced gas 454 may be circulation steam. Following the gate valve 420, circulation returns 212 from the injection module 200 may be introduced into the production gas line. A gate valve 4034 in flanged configuration on the circulation return line may be used to enable or disable the circulation returns 212. The circulation return line may also have a bleed 4032 socket welded off of the circulation return line.

A thermowell 458 may retrieve a temperature of the mixture of the production gas, the circulation returns, and/or the circulation steam. A temperature transmitter 460 may convert the temperature into an electrical signal for display on a temperature indicator 462.

A gate valve 464 may be socket welded off of the production gas line. The gate valve 464 may enable and/or disable the measurement of the pressure and/or facilitate replacement of the remaining pressure measurement elements. Following the gate valve 464, a pressure sampler 466 may comprise a needle valve receiving a pressure from the production gas line. A pressure transmitter 468 may convert the pressure into an electrical signal for transmission to a pressure indicator 470. The pressure measurement may be transmitted by a datalink to a pressure controller 480.

A bleed 472 may be socket welded off of the production gas line following the pressure sampler 466 and before a spring and diaphragm actuator 474, which may be in a flanged configuration on the production gas line. An interlock 476 may control a solenoid valve 478 that may provide industrial air 484 to the diaphragm of the spring and diaphragm actuator 474. A pressure converter 482 may be controlled by the pressure controller 480 in order to control the pressure supplied by the industrial air 484. Following the spring and diaphragm actuator 474 may be a check valve 486 in a flanged configuration and a bleed 488 socket welded off of the production gas line.

A test produced gas 4028 may be sampled from the production gas line. In this aspect, a ball valve 490 may be placed in a flanged configuration on the production gas line. A corresponding ball valve 4020 may be placed in a flanged configuration on the test produced gas line. Each of the ball valves 490, 4020 may be controlled by a quarter turn actuator. The production gas line ball valve 490 may have the quarter turn actuator receive a pneumatic signal from a solenoid valve 4004. The solenoid valve 4004 may be controlled by an interlock 4006 to provide industrial air 4008 to the quarter turn actuator of the production gas line ball valve 490. A position of the quarter turn actuator may be indicated by a position indicator 498 that may transmit the position over a datalink to an alarm 4010. When the ball valve 490 is enabled, the produced gas 4030 is provided. Following the ball valve 490 may be a pair of bleed valves 492, 494. One of the bleed valves 492 may be configured to bleed liquids and the other bleed valve 494 may be configured to bleed gases from the produced gas line.

Similarly on the test production gas line, the ball valve 4020 may have the quarter turn actuator receive a pneumatic signal from a solenoid valve 4018. The solenoid valve 4018 may be controlled by an interlock 4016 to provide industrial air 4014 to the quarter turn actuator of the test production gas line ball valve 4020. A position of the quarter turn actuator may be indicated by a position indicator 4024 that may transmit the position over a datalink to the alarm 4010. When the ball valve 4020 is enabled, the test produced gas 4028 may be provided. When the production ball valve 490 is open, then the test ball valve 4020 is closed. Likewise, when the production ball valve 490 is closed, then the test ball valve 4020 is open.

The production module 400 may receive an emulsion 4036 from the production well. A thermowell 4038 may retrieve a temperature of the mixture of the emulsion and/or the circulation steam. A temperature transmitter 4108 may convert the temperature into an electrical signal for display on a temperature indicator 4040.

A gate valve 4042 may be socket welded off of the emulsion line. The gate valve 4042 may enable and/or disable the measurement of the pressure and/or facilitate replacement of the remaining pressure measurement elements. Following the gate valve 4042, a needle valve device 4044 may comprise a needle valve receiving a pressure from the produced emulsion line. A pressure transmitter 4046 may convert the pressure into an electrical signal for transmission to a pressure indicator 4048. The pressure measurement may be transmitted by a datalink to a pressure controller 4062. The pressure measurement may be transmitted by a datalink to a pressure difference indicator 4050. The needle valve device 256 may allow an operator to confirm no pressure is trapped between valve 4042 and the pressure transmitter 4046 in the event that the pressure transmitter 4046 needs to be replaced.

Following the gate valve 4042 may be a gate valve 4052 in a flanged configuration off of the emulsion line along a line to the circulation steam line 214. The gate valve 4052 may be closed during an ESP production phase and may be open during the circulation phase. Also along the line to the circulation steam line 214 may be a check valve 4054 in a flanged configuration. A gate valve 4056 on the emulsion line may follow the line to the circulation steam line 214. Following the gate valve 4056 may be a pair of bleed valves 4058, 4076 socket welded off the emulsion line. One of the bleed valves 4076 may be configured to bleed liquids and the other bleed valve 4058 may be configured to bleed gases from the emulsion line.

A spring and diaphragm actuator 4060 may follow the bleed valves 4058, 4076 and may be in a flanged configuration on the emulsion line. An interlock 4066 may control a solenoid valve 4064 that may provide industrial air 4068 to the diaphragm of the spring and diaphragm actuator 4064. A pressure converter 4069 may be controlled by the pressure controller 4062 in order to control the pressure supplied by the industrial air 4068. Following the spring and diaphragm actuator 4060 may be a check valve 4070 in a flanged configuration and a bleed 4072 socket welded off of the production gas line.

A line may branch off the emulsion line to the produced gas line following the bleed 4072. The line may have a gate valve 4110.

A test emulsion 4104 may be sampled from the produced emulsion line. In this aspect, a ball valve 4076 may be placed in a flanged configuration on the emulsion line. A corresponding ball valve 4096 may be placed in a flanged configuration on the test emulsion line. Each of the ball valves 4076, 4096 may be controlled by a quarter turn actuator. The test emulsion line and the emulsion line may each have a bleed valve 4074, 4112 before each of the ball valves 4076, 4096. The emulsion line ball valve 4076 may have the quarter turn actuator receive a pneumatic signal from a solenoid valve 4078. The solenoid valve 4078 may be controlled by an interlock 4082 to provide industrial air 4080 to the quarter turn actuator of the emulsion line ball valve 4076. A position of the quarter turn actuator may be indicated by a position indicator 4088 that may transmit the position over a datalink to an alarm 4090. When the ball valve 4076 is enabled, the emulsion 4106 is provided.

Similarly on the test emulsion line, the ball valve 4096 may have the quarter turn actuator receive a pneumatic signal from a solenoid valve 4098. The solenoid valve 4098 may be controlled by an interlock 4102 to provide industrial air 4100 to the quarter turn actuator of the test emulsion line ball valve 4096. A position of the quarter turn actuator may be indicated by a position indicator 4092 that may transmit the position over a datalink to the alarm 4090. When the ball valve 4096 is enabled, the test emulsion 4104 may be provided. When the emulsion ball valve 4076 is open, then the test ball valve 4096 is closed. Likewise, when the emulsion ball valve 4076 is closed, then the test ball valve 4096 is open.

Figure 12A:
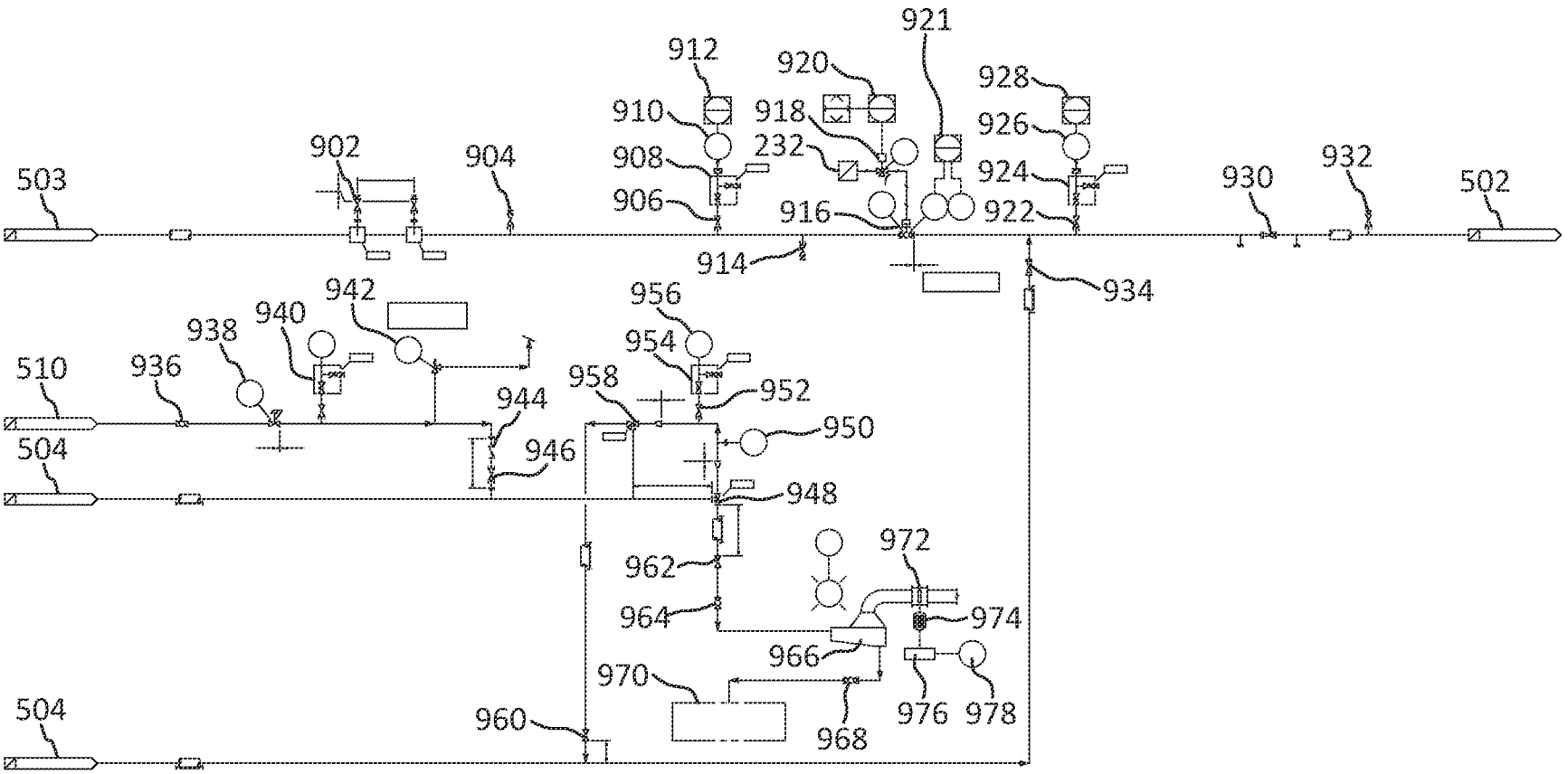
FIG. 12A to 12B are schematic diagrams of the hub module.
Figure 12B:
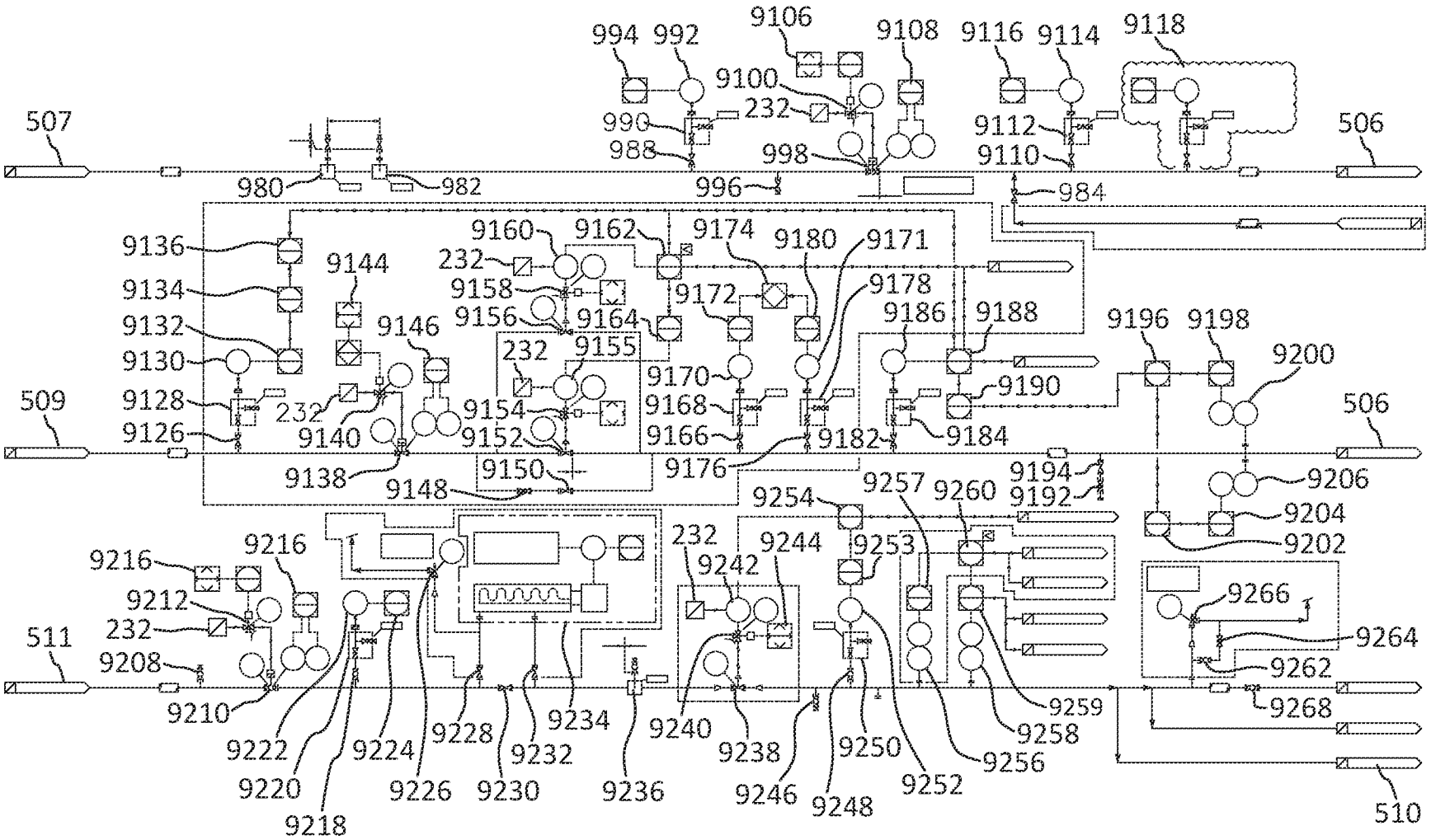

Turning to FIGS. 12A and 12B, the hub module 800 may permit the number of module configurations, as previously described, without requiring any substantial changes to the injection module 200, the production module 400, and/or the pipe rack module 300. The configuration of the hub module 800, as described herein, may be such that inlets and outlets of the hub module 800 may accommodate reversing an orientation of the pipe rack module 300 thereby allowing for well types to be on either side of the pipe rack module 300.

The configuration of the hub module 800 may allow for surface pipeline into the site from any direction.

With particular reference to FIG. 12A, the hub module 800 may comprise an emulsion line 503 from a group header. A pair of Hastelloy injection quills 902 may facilitate injection of chemicals into the emulsion line 503. Following the injection quills 902 may be a gate valve 904 to vent any gas in the emulsion line 503. A gate valve 906 may be coupled between the emulsion line 503 and a gauge valve 908 having a diaphragm coupled to a pressure transmitter 910, which may transmit the pressure measurements to a pressure indicator 912. The gate valve 906 may be closed in order to allow for replacement of the pressure transmitter 910 and/or the pressure indicator 912. A gate valve 914 may be used to drain the emulsion line 503. An emergency shutdown valve 916 may comprise a ball valve 916 that closes the emulsion line 503 on a failure. A quarter-turn actuator on the ball valve 916 may be activated by a pneumatic signal from a solenoid valve 918 that is supplied with industrial air 232. The solenoid valve 918 may be opened by an interlock 920 when a failure condition is determined. A position indicator 921 may indicate whether the emergency shutdown valve 916 is open or closed. The main emulsion line 503 may receive test emulsion 504 from the test separator module. A gate valve 934 may be closed to prevent test emulsion 504 from entering the main emulsion line 503.

A gate valve 922 may be coupled between the emulsion line 503 and a gauge valve 924 having a diaphragm coupled to a pressure transmitter 926, which may transmit the pressure measurements to a pressure indicator 928. The gate valve 922 may be closed in order to allow for replacement of the pressure transmitter 926 and/or the pressure indicator 928. This pressure indicator 928 may measure the pressure in the emulsion line 503 following the introduction of the test emulsion. The emulsion line 503 may comprise a gate valve 930 inline to stop emulsion from entering the emulsion pipeline 502. A vent valve 932 may vent gas following the inline gate valve 930.

The fuel gas line 510 may comprise a ball valve 936 prior to a self-actuated pressure reducing regulator 938 set to 3000 kPag. Following the pressure reducing regulator 938 may be a pressure indicator 940. A pressure safety valve 942 set to 3500 kPag may vent the fuel gas to atmosphere at excess pressure. Otherwise, the fuel gas may be introduced into the test emulsion line 504 via a check valve 944 and a gate valve 946, which may be closed for maintenance of either the fuel gas line 510 and/or the test emulsion line 504. The fuel gas may be introduced to sweep the test line clear of emulsion in order to reduce plugging.

Following the introduction of fuel gas to the test emulsion line 504, the test emulsion line 504 may branch into two lines, each line may reach a three-way valve 948, 958. One branch from the three-way valve 948 may comprise a temperature indicator 950 to determine the temperature of the test emulsion. Following the temperature indicator 950 may be a gate valve 952 leading to a gauge valve 954 where a pressure indicator 956 may provide the pressure of the test emulsion. This branch may then join the three-way valve 958. The other branch of the three-way valve 958 may join the larger test emulsion line 504 via a gate valve 960.

The other branch from the three-way valve 948 may comprise a gate valve 962 and a ball valve 964 leading to a sample box 966. The sample box 966 may be configured to receive a beaker and/or jar to be inserted to take a manual liquid sample from the sample line. The liquid sample may then be analyzed for certain key characteristics. The sample box 966 may vent to atmosphere with a fan 972 that may have a capacity greater than or about 10,000 CFM. The fan 972 may be rotated using a motor 974 provided with full voltage non-reversing supply and controlled by a hand switch 978. One or more samples from the sample box 966 may be provided to a drain tank 970 for each client via a ball valve 968.

Turning to FIG. 12B, the produced gas line 506, the high pressure steam line 508, and the fuel gas 510 of the hub module 800 are described. A pair of Hastelloy injection quills 980, 982 may facilitate injection of chemicals into the produced gas line 507 from the produced gas header. Following the injection quills 980, 982 may be a gate valve 988 may be coupled between the produced gas line 507 and a gauge valve 990 having a diaphragm coupled to a pressure transmitter 992, which may transmit the pressure measurements to a pressure indicator 994. The gate valve 988 may be closed in order to allow for replacement of the pressure transmitter 992 and/or the pressure indicator 994. A gate valve 996 may be used to drain the produced gas line 996. An emergency shutdown valve 998 may comprise a ball valve 998 that closes the produced gas line 507 on a failure. A quarter-turn actuator on the ball valve 998 may be activated by a pneumatic signal from a solenoid valve 9100 that is supplied with industrial air 232. The solenoid valve 9100 may be opened by an interlock 9106 when a failure condition is determined. A position indicator 9108 may indicate whether the emergency shutdown valve 998 is open or closed. The main produced gas line 507 may receive test fluids from the test separator module via a gate valve 984.

A gate valve 9110 may be coupled between the produced gas line 507 and a gauge valve 9112 having a diaphragm coupled to a pressure transmitter 9114, which may transmit the pressure measurements to a pressure indicator 9116. The gate valve 9110 may be closed in order to allow for replacement of the pressure transmitter 9114 and/or the pressure indicator 9116. This pressure indicator 9116 may measure the pressure in the produced gas line 507 following the introduction of the test fluids from the test separator. A redundant pressure measurement structure 9118 may be present in order to provide redundancy in case the previously described pressure measurement structure must go offline for maintenance or malfunctions.

Turning to the high pressure steam line 509, the high pressure steam line 509 may comprise a gate valve 9126 may be coupled between the high pressure steam line 509 and a gauge valve 9128 having a diaphragm coupled to a pressure transmitter 9130, which may transmit the pressure measurements to a pressure indicator 9132. The gate valve 9126 may be closed in order to allow for replacement of the pressure transmitter 9130 and/or the pressure indicator 9132. The pressure indicator 9132 may transmit the pressure measurements to a pressure controller 9134. A pressure differential indicator 9136 may display a pressure differential between a head end of the high pressure steam line 509 and a tail end of the high pressure steam line 508.

An emergency shutdown valve 9138 may comprise a quarter-turn actuator to halt high pressure steam flow on a fault condition. The valve 9138 may be activated by a pneumatic signal from a solenoid valve 9140 that is supplied with industrial air 232. The solenoid valve 9140 may be opened by an interlock 9144 when a failure condition is determined. A position indicator 9146 may indicate whether the emergency shutdown valve 9138 is open or closed.

The high pressure steam line 509 may branch into three branches. A first branch may comprise a globe valve 9148 and a gate valve 9150. A second branch may comprise a pressure regulation valve 9152 that may be provided with a pneumatic signal from a solenoid valve 9154 controlled by an interlock. The solenoid valve 9154 may be provided with industrial air 232 via a pressure converter 9155. The pressure converter 9155 may be controlled via an electrical signal from a position controller 9164. The third branch may comprise a pressure regulation valve 9156 that may be provided with a pneumatic signal from a solenoid valve 9158 controlled by an interlock. The solenoid valve 9158 may be provided with industrial air 232 via a pressure converter 9160. The pressure converter 9160 may provide an electrical signal from the pressure converter 9162. The position controller 9164 may in turn receive a pressure converter signal from the pressure converter 9162. The pressure converter 9162 may be coupled to a datalink receiving pressure signals from the pressure differential indicator 9136 and a pressure indicator 9188. All three branches may then return to the high pressure steam line 508. In this manner, the three branches may be used to regulate and/or reduce the pressure from the high pressure steam line 509 to the high pressure steam line 508 provided to the pipe rack module 300.

Following the merging of the three branches may be a pair of redundant pressure measurement structures, each comprising a gate valve 9166, 9176, a gauge valve 9168, 9178, a pressure transmitter 9170, 1971, and a pressure indicator 9172, 9180. The signals from the pressure indicators 9172, 9180 may be provided to a pressure indicator 9174 of a safety instrumentation system.

Following the redundant pressure measurement structures may be another pressure measurement structure comprising a gate valve 9182, a gauge valve 9184, a pressure transmitter 9186 providing an electrical signal to a pressure indicator 9188. This pressure indicator 9188 may provide pressure measurements via a datalink to the pressure converter 9162 and to temperature converter 9190. The temperature converter 9190 may provide temperature data to a temperature differential indicator 9196, which may display a temperature difference between the temperature converter 9190 and a temperature indicator 9198. The temperature indicator 9198 receives a temperature signal from a temperature transmitter and thermowell 9200. In some aspects, a reduntant temperature differential indicator 9202 may also receive a temperature signal from a redundant temperature indicator 9204 receiving a temperature signal from a temperature transmitter and thermowell 9206.

A condensate drain may comprise a gate valve 9194 and a globe valve 9192 prior to the high pressure steam header 506.

A fuel gas line 511 may have a vent valve 9208 prior to an emergency shutdown ball valve 9210. The emergency shutdown valve 9210 may comprise a quarter-turn actuator to halt fuel gas flow on a fault condition. The valve 9210 may be activated by a pneumatic signal from a solenoid valve 9212 that is supplied with industrial air 232. The solenoid valve 9212 may be opened by an interlock 9216 when a failure condition is determined. A position indicator 9216 may indicate whether the emergency shutdown valve 9210 is open or closed.

Following the emergency shutdown valve 9210 may be a pressure measurement structure comprising a gate valve 9218, a gauge valve 9220 and a pressure transmitter 9222. The pressure transmitter 9222 may receive a pressure measurement from the gauge valve 9220 and provide the measurement to a pressure controller 9224.

According to some aspects, the fuel gas line 511 may comprise a line heater 9234. The line heater 9234 may receive fuel gas from the fuel gas line 511 via a pair of gate valves 9228, 9232. The main fuel gas line 511 may comprise a gate valve 9230 separating the pair of gate valves 9228, 9232. A pressure safety valve 9226 may vent the fuel gas to atmosphere in the event of a fire. The pressure safety valve 9226 may have a set pressure of 9930 kPag. The line heater may comprise a gas heating element with a local control panel that may measure a temperature and have a temperature indicator. Following the line heater 9234 may be a Hastelloy quill 9236 reserved for methanol injection.

According to some aspects, a pressure regulator 9238 may regulate a pressure within the fuel gas line 511. The pressure regulator 9238 may receive a pneumatic signal from a solenoid valve 9240. The solenoid valve 9240 may be provided with instrument air 232 via a pressure converter 9242 and the solenoid valve 9240 may be controlled with an interlock 9244. The pressure converter 9242 may receive an electrical signal from a pressure controller 9254 in order to control the pressure provided to the pressure regulator 9238.

Following the pressure regulator 9238 may be a pressure measurement structure comprising a gate valve 9248 and a gauge valve 9250. A pressure transmitter 9252 may measure the pressure and provide an electrical signal to a pressure indicator 9253, which in turn may provide the pressure measurements to the pressure controller 9254.

Following the pressure measurement structure may be a thermowell and temperature transmitter 9256 providing a temperature measurement to a temperature indicator 9257 of the safety instrumentation system. The temperature indicator 9257 may provide the temperature measurements to a temperature converter 9260 that may convert the electrical temperature measurement signal into a signal suitable for a data link. Similarly, a redundant thermowell and temperature transmitter 9258 may provide a temperature indicator 9259.

The fuel gas line may then split into three branches. One branch may provide fuel gas to the sample station 510 as previously described. A second branch may provide make-up gas to a test separator module. A third branch may provide fuel gas to the fuel gas header via a ball valve 9268. Prior to the ball valve 9268 may be a pressure safety valve 9266 that may vent the fuel gas to atmosphere at a safe location. The pressure safety valve 9266 may have a setpoint pressure of 7960 kPag. The pressure safety valve 9266 may be bypassed by a ball valve 9262 and a globe valve 9264 in order to manually vent fuel gas to atmosphere or other venting requirements.

Although the description herein describes a particular order for each of the elements, one of skill in the art upon review of the present disclosure would know that certain connections may be reordered without departing from the function of the modules.

Although single or dual well pair modules have been described and shown herein, one of skill in the art on review of the present disclosure would consider that triple or quadruple well pair modules would fall within the teachings of the present disclosure.

According to another aspect, a process fluid, such as the bubble gas or the high pressure steam, may be provided to the producer well 700 via the production module 400. Another process fluid, such as the circulation returns 212, may be retrieved from the injection well 600 via the injection module 200.

In some aspects, the high pressure steam may be provided into the production well 700 via the production module 400 during a startup phase (e.g. first 3-months of operation). The emulsion may then be retrieved from the production well 700 via the production module 400. Similarly during the startup phase, the emulsion may be retrieved from the injection well 600 via the injection module 200 during injection of the high pressure steam.

Although particular pipe and/or valve sizes may be described and/or demonstrated in the drawings, the pipe and/or valve sizes may be modified to satisfy different sizes and/or numbers of wells. Although particular valve types may be described, other valves may be substituted for similar functionality valves.

According to aspects herein, the frame 206, 302 may facilitate moving the module by jacking and sliding the module and/or moving the module by crane.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

What is claimed is:

1. A steam assisted gravity drainage (SAGD) system comprising:

a hub module operatively coupled to at least one pipe rack module; the at least one pipe rack module having a first side and a second side and comprising a main high pressure steam line;

an injection module operatively coupled to at least one of the at least one pipe rack module; the injection module providing a high pressure steam via at least one high pressure steam line to at least one injection well, wherein the injection module receives the high pressure steam from the main high pressure steam line via a high pressure steam header;

a production module operatively coupled to at least one of the at least one pipe rack module; the production module receiving at least one emulsion into a produced emulsion line from at least one production well; and the hub module is configured to permit the injection module to be located on either the first side or the second side of the at least one pipe rack module and the production module to be located on either the first side or the second side of the at least one pipe rack module.

2. The SAGD system according to claim 1, wherein the at least one pipe rack module further comprises: a main emulsion line, a produced gas line, a fuel gas line, and an instrument air line.

3. The SAGD system according to claim 2, wherein the at least one pipe rack module further comprises at least one of: a test emulsion line and a test produced gas line.

4. The SAGD system according to claim 3, further comprising a steam sweep module at an end of the at least one pipe rack module; and the steam sweep module provides the high pressure steam to at least one of: the emulsion line, the produced gas line, the fuel gas line, the test emulsion line, and the test produced gas line.

5. The SAGD system according to claim 2, wherein the high pressure steam line receives the high pressure steam from the main high pressure steam line via at least one pressure reduction system.

6. The SAGD system according to claim 5, wherein the at least one pressure reduction system comprises a gate valve with a globe valve branching off an inlet of the gate valve and a flow return to the gate valve wherein adjusting the flow return through the globe valve results in a pressure adjustment to a supplied pressure to the injection module.

7. The SAGD system according to claim 2, wherein the production module provides the at least one emulsion from the production well to a production coupling of the pipe rack module; the production coupling introducing the at least one emulsion to the emulsion line.

8. The SAGD system according to claim 1, wherein the at least one high pressure steam line comprises a long string high pressure steam line and a short string high pressure steam line; the injection module separating the high pressure steam into the long string high pressure steam line and the short string high pressure steam line.

9. The SAGD system according to claim 8, wherein the long string high pressure steam line comprises:

a vortex flow meter with a flow indicator;

a spring and diaphragm actuator with a flow regulator controlled by a pneumatic signal from an instrument air line;

a pressure measurement system; and a fuel gas being introduced to the long string high pressure steam line via a fuel gas line.

10. The SAGD system according to claim 8, wherein the short string high pressure steam line comprises:

a vortex flow meter with a flow indicator;

a spring and diaphragm actuator with a flow regulator controlled by a pneumatic signal from an instrument air line; and a pressure measurement system.

11. The SAGD system according to claim 10, wherein the short string high pressure steam line further comprises a fuel gas being introduced to the short string high pressure steam line via a fuel gas line.

12. The SAGD system according to claim 10, wherein the short string high pressure steam line provides a circulation steam to the production module between the spring and diaphragm actuator and the pressure measurement system.

13. The SAGD system according to claim 12, wherein a thermowell for measuring a temperature of the at least one emulsion; and a pressure measurement system for measuring a pressure of the produced emulsion line.

14. The SAGD system according to claim 13, wherein the at least one pipe rack module further comprises: a test emulsion line, and a test produced gas line.

15. The SAGD system according to claim 14, wherein a test emulsion is sampled from the produced emulsion line and provided to a test emulsion line.

16. The SAGD system according to claim 13, wherein the circulation steam is introduced into the produced emulsion line before the thermowell.

17. The SAGD system according to claim 1, further comprises the production module receiving at least one produced gas from the production well.

18. The SAGD system according to claim 1, wherein the injection module is integrated into the pipe rack module.

19. The SAGD system according to claim 1, wherein the injection module further comprises receiving a process fluid from the at least one injection well.

20. The SAGD system according to claim 1, wherein the production module further comprises providing a process fluid to the at least one production well.

* * * * *